US011712819B2

(12) United States Patent
Baratta et al.

(10) Patent No.: US 11,712,819 B2
(45) Date of Patent: Aug. 1, 2023

(54) WALL SAW AND INTERCHANGEABLE ASSEMBLIES FOR WALL SAWS

(71) Applicant: HUSQVARNA AB, Huskvarna (SE)

(72) Inventors: Anthony Baratta, Oak Park, CA (US); Peter Zetterlind, Hallsberg (SE); Andreas Jönsson, Hallsberg (SE)

(73) Assignee: HUSQVARNA AB, Huskvarna (SE)

( * ) Notice: Subject to any disclaimer, the term of this patent is extended or adjusted under 35 U.S.C. 154(b) by 355 days.

(21) Appl. No.: 17/118,905

(22) Filed: Dec. 11, 2020

(65) Prior Publication Data

US 2021/0114256 A1 Apr. 22, 2021

Related U.S. Application Data

(60) Continuation of application No. 14/880,569, filed on Oct. 12, 2015, now Pat. No. 10,889,024, which is a division of application No. 13/387,687, filed as application No. PCT/US2010/042778 on Jul. 21, 2010, now Pat. No. 9,174,360.

(Continued)

(51) Int. Cl.

| | |
|---|---|
| ***B28D 1/08*** | (2006.01) |
| ***B27B 17/00*** | (2006.01) |
| ***B27B 17/08*** | (2006.01) |
| ***B27B 17/14*** | (2006.01) |

(52) U.S. Cl.

CPC ..... *B28D 1/084* (2013.01); *B27B 17/0083* (2013.01); *B27B 17/08* (2013.01); *B27B 17/14* (2013.01)

(58) Field of Classification Search

CPC . B27B 17/0016; B27B 17/0083; B27B 17/08; B27B 17/086; B27B 17/10; B28D 1/084

See application file for complete search history.

(56) References Cited

U.S. PATENT DOCUMENTS

| | | | |
|---|---|---|---|
| 855,237 | A | 5/1907 | Dunn |
| 2,776,575 | A | 1/1957 | Michie |

(Continued)

FOREIGN PATENT DOCUMENTS

| | | | |
|---|---|---|---|
| CN | 1657242 | A | 8/2005 |
| CN | 201012505 | Y | 1/2008 |

(Continued)

OTHER PUBLICATIONS

International Search Report and Written Opinion in the International Application No. PCT/US2010/042778 dated Mar. 22, 2011.

(Continued)

*Primary Examiner* — Tyrone V Hall, Jr.
(74) *Attorney, Agent, or Firm* — Burr & Forman LLP

(57) ABSTRACT

A concrete cutting machine includes a motor, a pivot arm, and a concrete cutting chain assembly. The motor has an output drive, and the pivot arm has an input coupled to the output drive for receiving power from the motor. The arm is configured to pivot relative to the motor, and the pivot arm has a pivot arm output. The concrete cutting chain assembly is supported on the pivot arm and has a power input coupled to the pivot arm output. The chain assembly is configured to be pivotable relative to the pivot arm.

12 Claims, 33 Drawing Sheets

Related U.S. Application Data

(60) Provisional application No. 61/364,773, filed on Jul. 15, 2010, provisional application No. 61/325,263, filed on Apr. 16, 2010, provisional application No. 61/319,565, filed on Mar. 31, 2010, provisional application No. 61/230,119, filed on Jul. 31, 2009.

(56) References Cited

U.S. PATENT DOCUMENTS

| | | | | |
|---|---|---|---|---|
| 2,839,097 | A | 6/1958 | Siria | |
| 2,925,104 | A | 2/1960 | Allemann | |
| 3,266,534 | A | 8/1966 | Carnesecca et al. | |
| 3,311,415 | A | 3/1967 | Miller | |
| 3,545,422 | A | 12/1970 | McNulty et al. | |
| 3,593,700 | A | 7/1971 | McNulty et al. | |
| 3,722,497 | A | 3/1973 | Hiestand et al. | |
| 3,753,430 | A | 8/1973 | Oas | |
| 3,763,845 | A | 10/1973 | Hiestand et al. | |
| 4,033,035 | A | 7/1977 | Trimmer | |
| 4,121,336 | A | 10/1978 | Loyd | |
| 4,181,115 | A * | 1/1980 | Weisner | B28D 1/082 83/72 |
| 4,382,334 | A | 5/1983 | Reynolds | |
| 4,603,678 | A | 8/1986 | Fish | |
| 4,649,644 | A | 3/1987 | Huddleston | |
| 4,821,415 | A | 4/1989 | Kress | |
| 4,836,494 | A | 6/1989 | Johnsen | |
| 4,920,947 | A | 5/1990 | Scott | |
| 4,981,129 | A * | 1/1991 | Osterman | B27B 17/08 30/384 |
| 4,986,252 | A | 1/1991 | Holmes et al. | |
| 5,730,561 | A | 3/1998 | Wambeke | |
| 5,802,946 | A * | 9/1998 | Leini | B27B 17/08 144/34.1 |
| 6,311,598 | B1 * | 11/2001 | Osborne | B27B 17/0083 30/372 |
| 6,955,167 | B2 | 10/2005 | Baratta | |
| 2005/0115379 | A1 | 6/2005 | Schulz et al. | |
| 2006/0201492 | A1 | 9/2006 | Baratta et al. | |
| 2007/0163412 | A1 | 7/2007 | Baratta et al. | |

FOREIGN PATENT DOCUMENTS

| | | | |
|---|---|---|---|
| CN | 201179671 | Y | 1/2009 |
| FR | 1099801 | A | 9/1955 |
| GB | 682573 | A | 11/1952 |
| JP | H0248164 | A | 2/1990 |
| JP | H0297335 | A | 4/1990 |
| JP | H08258002 | A | 10/1996 |
| JP | 2002210727 | A | 7/2002 |
| JP | 2007062204 | A | 3/2007 |
| WO | 2008130304 | A1 | 10/2008 |

OTHER PUBLICATIONS

Chapter II International Preliminary Report on Patentability in the International Application No. PCT/US2010/042778 dated Aug. 30, 2011.

Marshall Brain "How Gear Ratios Work" Apr. 1, 2000. HowStuffWorks.com. <https://auto.howstuffworks.com/gears.htm> Sep. 28, 2018 (Year: 2000).

* cited by examiner 434
409
408
459
432
436
408A
440
454
452
406
438
448
450
449
404
442
444
451
312
320
404x
404y 510
512
612
566
620
590

508
510
554
512
502
506
512
552

508
514
514

566
620
590
612
510
512

508
506
502
514
514
510
516
552
512
506
514
554
612

WALL SAW AND INTERCHANGEABLE ASSEMBLIES FOR WALL SAWS

CROSS REFERENCE TO RELATED APPLICATIONS

The present application is a continuation of U.S. application Ser. No. 14/880,569 filed Oct. 12, 2015 which is a divisional of U.S. application Ser. No. 13/387,687 filed Jan. 27, 2012, which is a national phase entry of PCT/US2010/042778 filed Jul. 21, 2010, which claims the benefit of U.S. Provisional Applications Nos. 61/364,773 filed Jul. 15, 2010; 61/325,263 filed Apr. 16, 2010; 61/319,565 filed Mar. 31, 2010; and 61/230,119 filed Jul. 31, 2009; all of which are expressly incorporated by reference in their entirety.

BACKGROUND

This relates to wall saws and other equipment and chainsaw cutting heads that can be attached to wall saws and such other equipment, and components and methods relating thereto. This also relates to machining tools other than chain saws that can be attached to wall saws and such other equipment, as well as components and methods relating thereto.

US Application Publication No. US20070163412 discusses details of a wall saw with which the present apparatus can be used, and of which the entire disclosure is hereby expressly incorporated by reference.

SUMMARY

Apparatus and methods are disclosed for using a single machine for several applications, for example a wall saw for cutting concrete with a flat, circular blade attachment and also for cutting concrete with a chainsaw attachment, such as for corner cuts or deep cuts. With a wall saw application, as well as others where precision positioning of the cutting tool is advantageous, the cutting line for the blade and a cutting line for the chainsaw can be identical without significant alignment, positioning and adjustment issues. In one example, a corner cutting chainsaw capability is built into a conventional wall saw, and in many examples of wall saws, the chainsaw cutting capability can be incorporated to operate within the cutting envelope of the original wall saw cutting package. Additionally, in at least one example, the chainsaw cutting capability can be incorporated into a wall saw without requiring additional motors, additional operating controls, and without additional power supplies or power packs or plumbing. The chainsaw cutting capability can accommodate multiple chain bar sizes and widths, can be implemented with a flush cut capability, can be quickly assembled for operation (for example in five minutes or less), and is lightweight and easy to use.

In one example of apparatus and methods, a concrete cutting machine includes a motor with an output drive and a pivot arm having a drive input coupled to the output drive of the motor. The arm pivots relative to the motor and has a drive output for driving a concrete cutting chain assembly or other longitudinally extending tool. In one configuration, the chain assembly can be removed and a cutting blade mounted to the arm, for example a circular saw blade. In another configuration, the pivot arm includes an interface and the chain assembly is supported on the interface in such a way that the chain assembly can pivot relative to the pivot arm. Additionally, the chain assembly can pivot relative to the pivot arm about an axis coaxial with a drive shaft in the pivot arm for driving the chain assembly. In such a configuration, the chain assembly or other longitudinal tool can be driven through the pivot arm and can also pivot relative to the pivot arm.

In the example of a chain bar cutting assembly, the chain bar can be configured to plunge cut substantially normal to the concrete surface for a number of angular positions of the pivot arm. The tool can be positioned on the pivot arm at a number of discrete angular locations, or at angular positions continuously over an arc or circle, as desired. In a further configuration, one or more other components can also be supported by the pivot arm, which other component could also pivot relative to the pivot arm. Such other component could, in one example, be a chain guard or blade guard structure. In the example of a chain guard, the chain guard could be configured to pivot independently of the chain bar, for example so that the chain guard can stay flush with the cutting surface while the chain bar might pivot within the cut, or while the arm might pivot relative to the chain bar and the work piece. The chain guard can be indexed or continuously moveable.

In a further example of apparatus and methods, a chainsaw cutting assembly for use as a chainsaw includes a chain bar support for receiving and securely supporting a chain bar and a cutting chain. A drive sprocket adjacent to the chain bar support supports and drives the cutting chain. A gear assembly has a drive input and couples the drive input to the drive sprocket and is configured to change the RPM at the drive input to a different RPM at the drive sprocket. In one configuration, the gear assembly increases the RPM at the drive sprocket, in another configuration, the gear assembly approximately triples the RPM to the drive sprocket and in another makes it about four times the starting RPM. In one example, the gear assembly changes an input rpm of between about 1200 and 1500 to a drive sprocket rpm of between about 5000 and 5800. The assembly may also include one or more clutches. Additionally, the drive sprocket can be easily replaceable.

In another example of apparatus and methods, a concrete cutting machine includes a motor with an output and a pivot arm with a pivot arm output driven by the motor output. The pivot arm is configured to support and drive a concrete cutting chain assembly. In one configuration, the pivot arm has a mounting element configured to accept either one of a circular saw blade and a chainsaw. In another configuration, the pivot arm output includes a drive shaft having an axis and the chain assembly pivots about the driveshaft axis. Additionally, the pivot arm can be configured to pivot relative to the motor through an arc of 360°. The motor may include a drive element to pivot the pivot arm, and the motor can also include securement elements to secure the motor to a carriage. The motor can also include fittings or connections for receiving power input. The motor can be configured to receive power as desired, for example from hydraulic power sources, high cycle, pneumatic, or other available power sources.

In a further example of apparatus and methods, a concrete cutting assembly includes a motor with an output drive shaft and a pivoting arm on and driven by the motor. The arm includes an interface configured to receive a circular saw blade and a concrete cutting chain or other longitudinal tool. In one configuration, the chainsaw pivots relative to the arm, and the chainsaw can pivot on an axis coaxial with a chainsaw driveshaft. The interface can be configured to receive a mounting element for an inner blade flange of a saw blade and a mounting element for a chainsaw drive gearbox. The driveshaft for the saw blade and the chainsaw can be axially movable relative to the pivot arm, for example retractable. When each respectively is mounted on the pivot arm, the cutting blade and the chainsaw can be positioned and operate in the same plane.

The interface can also be configured so that each of the cutting blade and the chainsaw are suitable for flush cut operation. Additionally, the motor can be mounted on a carriage and the carriage can be mounted on a track so that either of the cutting blade and chainsaw or other longitudinal tool can be used on the pivot arm to cut concrete anywhere along the track. With the interface, both the cutting blade and the chain bar can be used to mount, secure and drive either of a cutting blade or a chainsaw. For example, the same support can be used for supporting a blade flange and a chain bar, and when either one is used, it can use the same water supply as the other would use. The same pivot arm can support and drive either one, and the same motor can be used to drive either one, as well as the pivot arm, and the same carriage can be used to support and guide either one on a track. Either one can be powered with the same power pack or power supply as the other, and one need not require a different power source than the other.

In another example of apparatus and methods, a concrete cutting assembly includes a motor output and a movable arm supported on the motor. The arm includes an output driven by the motor and a circular blade cutting assembly removably mounted on the arm and driven by the arm output, and configured so that when the blade assembly is removed, a chainsaw cutting assembly can be mounted on the arm and driven by the arm output for driving the chain. When either is mounted on the arm, the cutting element cuts in the same plane as the other. In one configuration, the chainsaw can pivot about an axis relative to the arm. In another configuration, the arm drive output is coaxial with a pivot axis for the chainsaw. Therefore, they can both pivot in the same plane, have the same pivot axis and have the same drive element. They can also use the same arm, motor and power source, carriage and track.

In a further example, a concrete cutting assembly includes a motor supported on a support and having a driveshaft driven by a power source. A drive assembly is coupled to the driveshaft and includes an interface configured to support a cutting blade and configured to support a chainsaw assembly from the same interface when the cutting blade is removed. The cutting blade and the chainsaw assembly or driven from the same assembly drive output. The motor can be configured to accept power input from a selected power source, which may be any one of several available power sources, for example hydraulic, high cycle, pneumatic or other sources that may be available. Consequently, both tools can be driven by the same power source, the same motor and using the same interface, for example on a pivot arm. The same controls can operate both, the same water supply can be used on both, the same support configurations can be used on both, and one can be interchanged with the other in a relatively short amount of time. Exchanging tools does not require changing motors, changing tracks, or realigning equipment.

In another example, a wall saw with cutting blade can be set up and used as desired. Near the end of a cut, where a corner is to be finished, the cutting blade and blade flange can be removed and the chainsaw cutting head installed and positioned. In one example, the chainsaw cutting head would include a chain bar, cutting chain, drive and nose sprockets, chain tensioning assembly, water or other cooling supply and a gear conversion assembly to convert from the cutting blade output rpm (for example 1500 rpm) to the chainsaw rpm (for example 5000 rpm). The wall saw carriage and motor assembly and gearbox can remain in place, and the chainsaw can be positioned in the same cutting line as the cutting blade just removed. No plumbing other than the chain cooling need be disconnected or set up, no motors need be added or removed, no controls need be added or removed, and the setup can be done quickly.

In another example, a chainsaw cutting tool is provided and can be used on a wall saw or other cutting device. In the example of a wall saw, the chainsaw cutting tool includes a drive input assembly, for being coupled to a saw blade output or drive shaft, and also includes a gearbox and a chainsaw assembly. In one example, the chainsaw assembly includes a drive sprocket, chain bar and cutting chain and a nose sprocket. The chainsaw cutting tool also includes a coolant supply. Various coolant and lubricant seals may also be included. In the example of a wall saw such as that disclosed in US Patent Publication No. 2007/0163412, the chainsaw cutting tool can also include a mounting shoe or groove for sliding over the indexing ring of the wall saw gearbox.

In a further example, a chainsaw cutting tool having a chain bar, drive sprocket, nose sprocket, cutting chain and housing, and a chain tensioning assembly can include components internal to the housing. Access to the tensioning assembly can be at a bottom of the housing, and an actuating element for tensioning the chain can extend through a side opening in the housing.

In a further example of a chainsaw cutting package, for example one that can be used on a wall saw, the chainsaw cutting package includes a chainsaw drive sprocket that can be replaceable with other sprocket configurations. For example, an outer sprocket flange can be removed to expose the drive sprocket. The drive sprocket can be removed and replaced with a different drive sprocket, and the outer sprocket flange replaced and secured. The replacement drive sprocket can be identical to replace a worn drive sprocket, or can be a different size to accommodate a different cutting chain or cutting capability, as desired.

In another example, a wall saw assembly can have a wall saw cutting blade package and a chainsaw cutting package, each of which operate within the same cutting envelope of the other. When either of the wall saw cutting blade package and the chainsaw cutting package is attached to the wall saw output driveshaft, the cutting tool (blade or chainsaw) is in a single plane and follows a single cutting line. Additionally, both the wall saw cutting blade package and the chainsaw cutting package can be configured for flush cutting. In a further example, a wall saw including a cutting blade is operated on a wall saw track. The cutting blade is removed from a cutting blade driveshaft and a chainsaw is mounted to be driven by the cutting blade driveshaft. The chainsaw can generally have the same freedom of movement and range of movement as the cutting blade. The chainsaw can move forward and backward along the track, and up and down within the cut.

Another example has a wall saw with a cutting blade operating with a first set of controls and motor and power supply. The cutting blade can be removed and a chainsaw assembly installed on the wall saw, and the same set of controls, motor and power supply can be used to operate the chainsaw assembly.

In another example of a wall saw with a cutting blade, the wall saw is stopped and the cutting blade removed by loosening a securing bolt in the blade driveshaft. In the example of a wall saw such as that disclosed in US Patent Publication Number 2007/0163412, the blade driveshaft is pressed to be recessed in the gearbox assembly. A chainsaw assembly is slid onto the indexing plate of the wall saw gearbox and the blade driveshaft aligned with and inserted into a mating drive hub in the chainsaw assembly. The securing bolt is then tightened down so that the drive hub is secured to the blade driveshaft on the gearbox. The chainsaw is then positioned as desired and driven to cut the workpiece as desired.

These and other examples are set forth more fully below in conjunction with drawings, a brief description of which follows.

DETAILED DESCRIPTION

Figure 1:
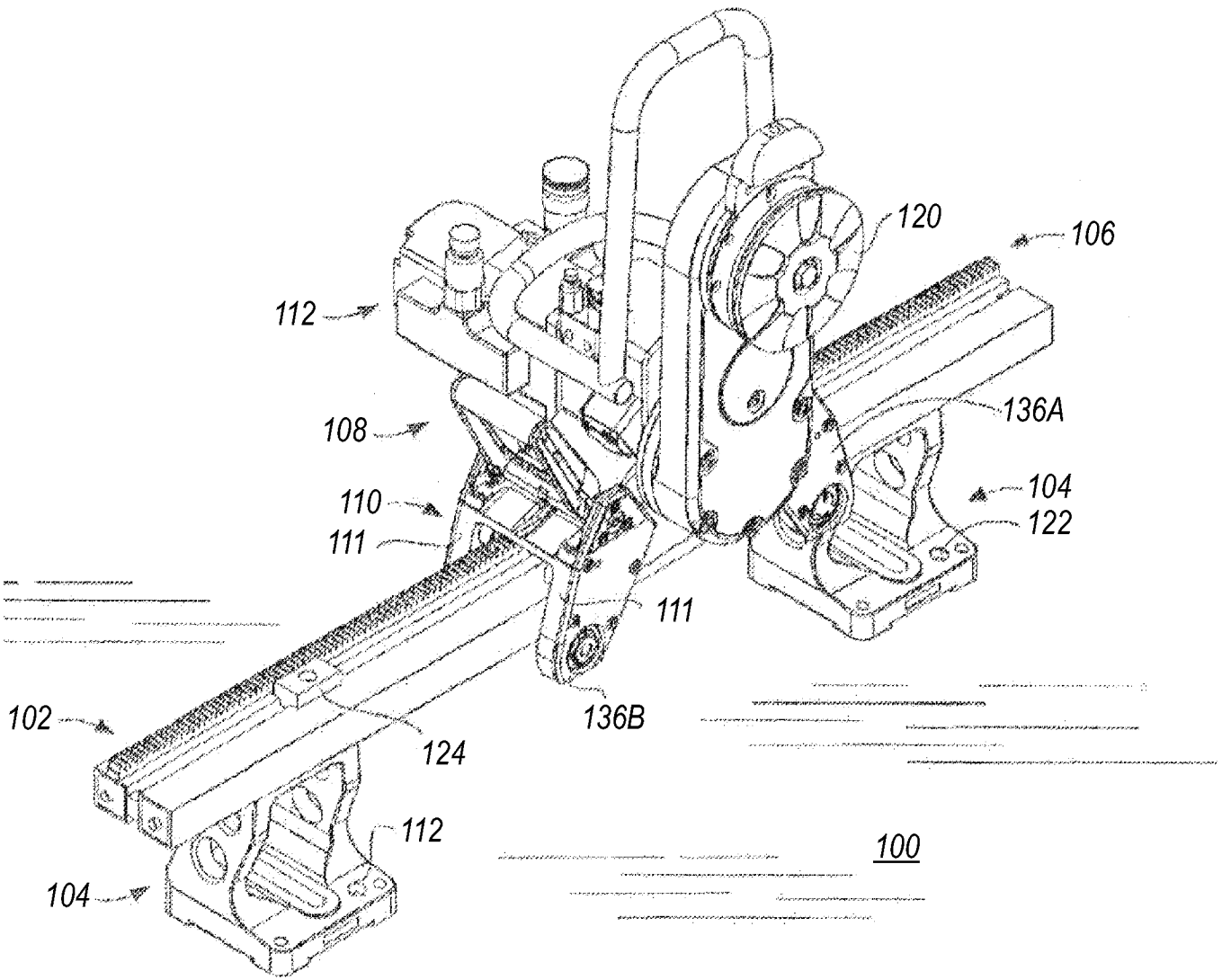
FIG. 1 is an isometric view of a wall saw assembly and wall saw track, as an example of an assembly with which a chainsaw attachment can be used.
Figure 1B:
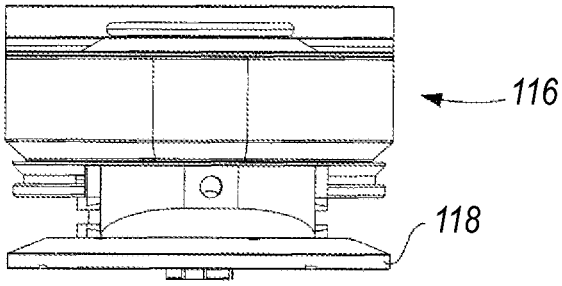
FIG. 1B is a top plan view of the gearbox assembly of FIG. 1A.
Figure 1A:
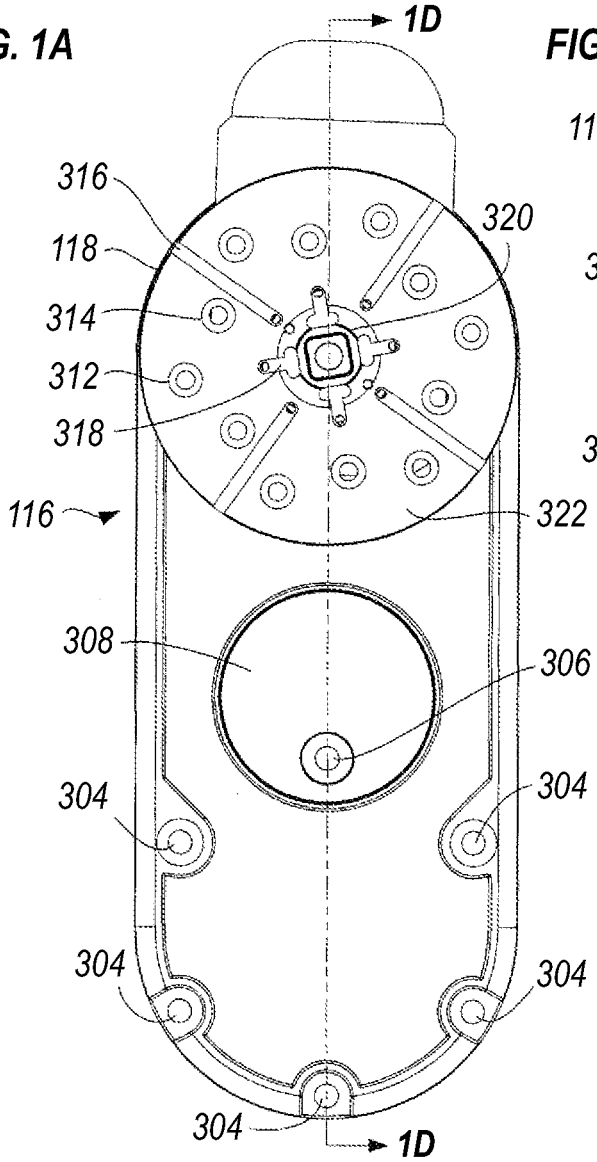
FIG. 1A is a front elevation view of a gearbox, blade mounting flange and water supply 25 manifold of the wall saw of FIG. 1.
Figure 1C:
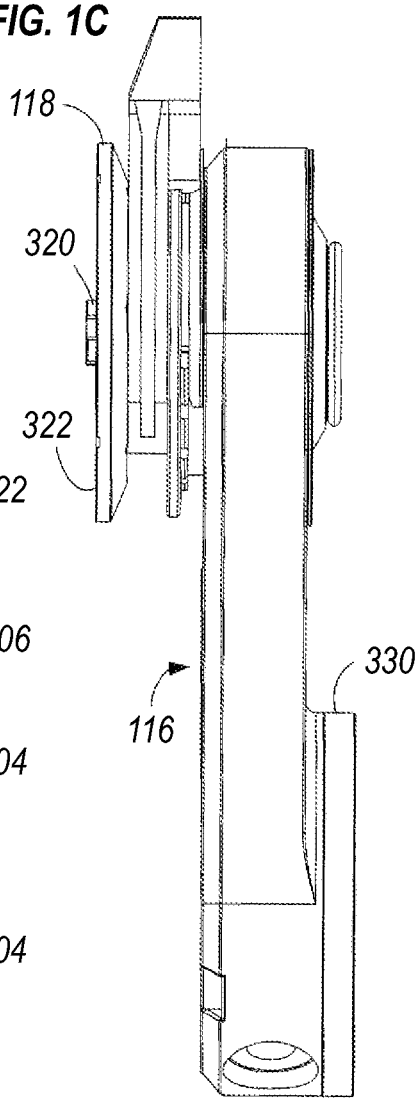
FIG. 1C is a side elevation view of the gearbox assembly of FIG. 1A.

This description, taken in conjunction with the drawings, sets forth examples of apparatus and methods incorporating one or more aspects of the presently disclosed inventions in such a manner that any person skilled in the art can make and use the same. The examples provide the best modes contemplated for carrying out the inventions, although it should be understood that various modifications can be accomplished within the parameters of the present inventions.

Examples of machining tools and of methods of making and using the machining tools are described. Depending on what feature or features are incorporated in a given structure or a given method, benefits can be achieved in the structure or the method. For example, tools using carriages with removable driving heads may be easier to use and maintain. They may also take less time in set up, and break down. Additionally, some machining tool configurations may also benefit from lighter-weight components, and lower-cost, and greater ease in making adjustments in the field. Some machining tool configurations may also allow use of larger tools to begin or end jobs, or allow fewer change outs during a given job.

In some configurations of machining tools, improvements can be achieved also in assembly, and in some configurations, a relatively small number of components can be used to provide a larger number of configurations of machining tools. For example, in a wall saw, one or a few wall saw configurations can be used for several different cutting jobs, such as slab or wall cutting and corner cutting.

These and other benefits will become more apparent with consideration of the description of the examples herein. However, it should be understood that not all of the benefits or features discussed with respect to a particular example must be incorporated into a tool, component or method in order to achieve one or more benefits contemplated by these examples. Additionally, it should be understood that features of the examples can be incorporated into a tool, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method. In another example, some of the features described herein can be used on a wall saw but without the flush cut capability, and still achieve such benefits as the ability to use the same cut line, use the same motors and power packs, quick change time, and the like. In another adaptation, some of the features can be adopted, though without the ability to use the same cut line as was formed by another tool, but still use the same wall saw power pack, motor, arm, and the like.

Examples of tool configurations and of methods of making and using the tools are described or shown herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Chain saw configurations are used as examples of a tool that can incorporate one or more of the features and derive some of the benefits described herein, and in particular for attachment to wall saws. However, tools other than chain saw configurations and equipment other than wall saws can benefit from one or more of the present inventions.

It should be understood that terminology used for orientation, such as front, rear, side, left and right, upper and lower, and the like, are used herein merely for ease of understanding and reference, and are not used as exclusive terms for the structures being described and illustrated.

Wall saws are used as examples of machining tools that can incorporate one or more of the features and derive some of the benefits described herein, and in particular concrete wall saws. Wall saws are often heavy and drive very large saw blades, especially compared to the sizes of the track and the hardware used to drive the saw blade itself. However, movable machining tools other than wall saws can benefit from one or more of the present inventions.

One example of a wall saw is shown in FIG. 1, in which is shown a concrete surface 100, and a track 102 mounted to the concrete surface through track brackets 104. The track 102 shown in FIG. 1 includes a pair of parallel beams fixed together, one of which has a gear track 106 along which the saw 108 travels. The saw includes a carriage 110 supporting a drive assembly and tool support, collectively referred to as the drive assembly 112. The carriage 110 is formed from a carriage body 111 and various components mounted to the carriage body, as described more fully in the referenced published patent application. A blade (not shown) is supported on a blade arm/gearbox 116 by inner and outer blade flanges 118 and 120, respectively. When the wall saw is configured for use with a blade as shown in FIG. 1, the term blade arm 116 is used. Additionally, the blade arm 116 can alternatively be described as a pivot arm 116 when implemented with respect to a chainsaw assembly as described herein. The pivot arm 116 pivots in relation to the wall saw.

As shown in FIG. 1, the gear track 106 is not centered on the track, but instead is offset to one side. If a cut is to be made on the near side of the track shown in FIG. 1, the blade is mounted on the saw and brought into contact with the concrete surface when up to speed. A line is then cut in the concrete to the desired depth by moving the saw along the track 102. If a cut is to be made on the far side of the track shown in FIG. 1, the drive assembly 112 can be lifted (with the blade flange assembly removed) and removed from the carriage 110 and rotated in a plane parallel to the concrete surface 180 degrees and repositioned on the carriage so that the blade is positioned on the far side of the track. A line can then be cut in the concrete without having to remove or reposition the carriage on the track.

The carriage is mounted and positioned on the track through various rollers. The carriage is supported on the top of the track by upper rotatable rollers vertically and horizontally fixed to an under side of the carriage 110. The illustrated carriage uses eight upper rollers. The carriage is supported from below the track by lower adjustable rotatable rollers. The lower rollers are axially movable relative to the side legs of the carriage, so they can be withdrawn into the legs to give clearance for placing the carriage on the track or removing the carriage. The lower rollers include assemblies having eccentric components for adjusting the position of the rollers, thereby more closely securing the carriage on track. In the illustrated example, there is one lower roller for each leg of the carriage. The positions of the lower rollers can be adjusted upward and downward, or closer to or farther from the track. The directional designations of "upper" and "downward" and other directional designations are made relative to the track, to the drawing orientation or other similar reference point. Because the track and wall saw can be mounted on vertical, horizontal and other oriented surfaces, the directional designations are not made relative to a horizon unless otherwise specifically noted.

The carriage 110 and the drive assembly 112 can be stored and carried separately, and the carriage can be placed on the track separate from the drive assembly. The drive assembly is removable from the body of the carriage. The carriage can be mounted on the track separately from the drive assembly by first pressing outwardly each of the four lower rollers so that the inwardly facing surfaces of each roller are substantially flush with the inside surfaces of the legs. The carriage is placed over the track so that the upper rollers rest on the top surfaces of the track and the travel gear engages the rack 106. The lower rollers are then pressed inward under the track to support the carriage from below.

With the carriage reliably positioned on the track, the carriage can support and reliably hold the drive assembly relative to the track, thereby allowing reliable and accurate cutting by the blade. The carriage can support and hold the drive assembly in a number of ways, some of which do not use bolts or other threaded fasteners in the process of locking down or securing the drive assembly on the carriage or which do not use bolts or other threaded fasteners in releasing the drive assembly from the carriage.

The wall saw 108 can be assembled and operated as discussed in US Patent Publication No. 2007/0163412, incorporated herein by reference (hereafter "US Patent Publication"). As discussed in that specification, the wall saw includes an arm 116 that pivots relative to the motor and carriage. In the example of the wall saw in the US Patent Publication, the arm is a gearbox.

The gearbox 116 includes an inner blade flange 118 mounted to a blade drive shaft for driving the saw blade. The inner blade flange includes a first plurality of threaded openings 312 oriented on a first circle for receiving fasteners for mounting a blade having mounting holes corresponding to a first mounting configuration, and a second plurality of threaded openings 314 oriented on a second circle for receiving fasteners for mounting the blade according to a second mounting configuration. The inner mounting flange also includes a plurality of channels 316 for guiding cooling fluid such as water from the flange along the outside of the blade. Additional channels 318 can be used to pass water to an outer blade flange 120 (FIG. 1) if an outer blade flange is used. A blade supporting boss 320 extends outward from the face 322 of the inner blade flange for supporting the blade and for engaging the outside of a complementary surface on the outer blade flange 120.

Considering the gearbox in more detail with respect to FIGS. 1D-1G and 1I, the input portion 348 includes the clutch plate 310, which is sandwiched between the body of the gearbox and the housing of the drive assembly. The clutch plate includes an opening for receiving the blade drive input shaft, which is supported by bearings (not shown) in counter bores 350 and 352. Lubricating fluid may be provided into an oil bath area 354 through an opening 356. The blade drive input shaft gear engages a medial gear 358, which is supported in the gearbox by the medial gear shaft 308 through a pair of radial bearings 360 positioned on opposite sides of a ring 362 on the interior surface of the gear. The radial bearings 360 are dimensioned so as to fit within the envelope defined by the width of the gear. The radial bearings 360 are spaced radially outward from the support shaft 308, and the gear 358 is spaced radially outward from the radial bearings 360. This packaging of the gear and the bearings allows a thinner gearbox relative to a gear supported on an axially longer shaft with bearings outboard of the gear envelope.

Figure 1D:
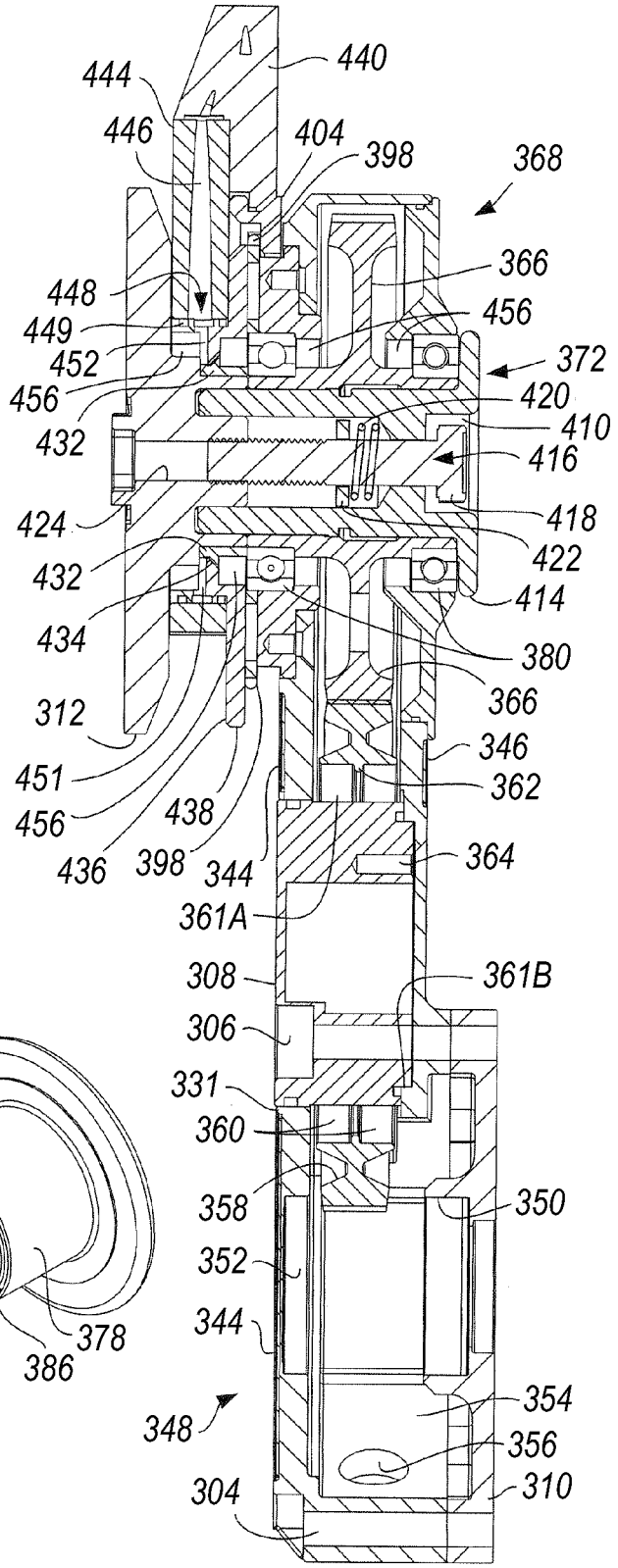
FIG. 1D is a cross-sectional view of the gearbox assembly of FIG. 1A taken along line 1D-1D.
Figure 1I:
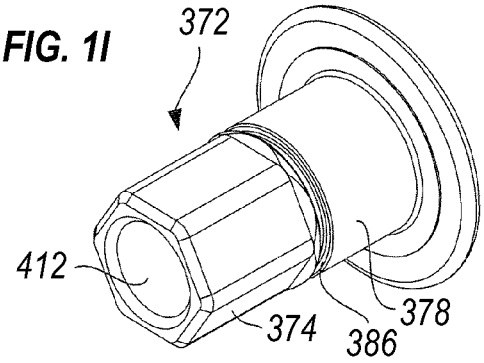
FIG. 1I is an isometric view of a blade drive shaft for use with the gearbox assembly of FIG. 1A.
Figure 1G:
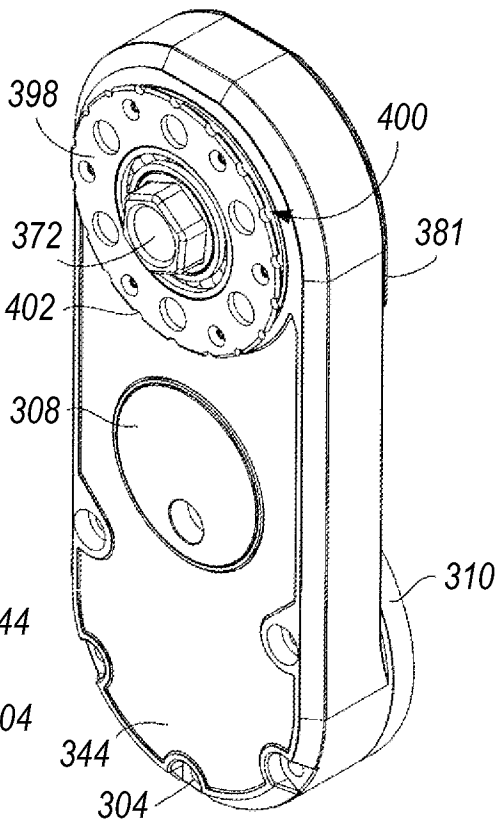
FIG. 1G is an isometric view of the gearbox assembly of FIG. 1E showing the drive shaft extended.
Figure 1E:
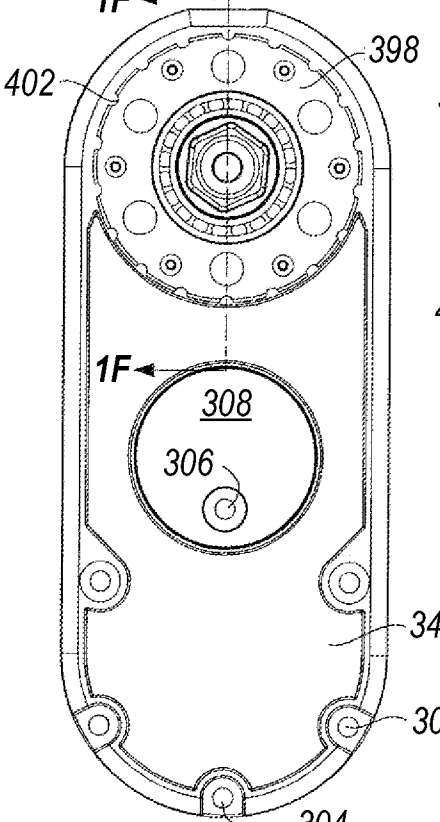
FIG. 1E is a front elevation view of a gearbox assembly of FIG. 1 (without the blade mounting flange and water supply manifold) showing a support for a blade mounting flange.

The medial gear shaft 308 is supported laterally ("laterally" here meaning of the gearbox rather than laterally relative to the direction of cutting) by the walls of the gearbox. In the example shown in FIG. 1D, the medial gear shaft includes two differently sized cylindrical portions 361A and 361 B. The first and larger diameter cylindrical portion 361A is supported by the gearbox wall defined in part by the rim 330 in the outer side 326 of the gearbox (FIG. 1D). The second and smaller diameter cylindrical portion 361B is supported from the sides by the sidewall for a circular recess on the inside surface of the gearbox inner side. These portions of the gearbox walls help to support the medial gear shaft in side loading that the gear shaft experiences.

The medial gear shaft 308 is also supported axially by being held in place by a fastener through the bore 306 and by a fastener in the bore 364. The first fastener in the bore 306 is shared with the five other fasteners mounting the gearbox on the drive assembly. The fastener through the bore 306 extends completely through the interior of the medial gear 358. The gear turns around the fastener in the bore 306. The medial gear shaft 308 is sealed in the gearbox housing through 0-rings (not shown) in the 0-ring grooves in the perimeter of the medial drive shaft 308.

Figure 1F:
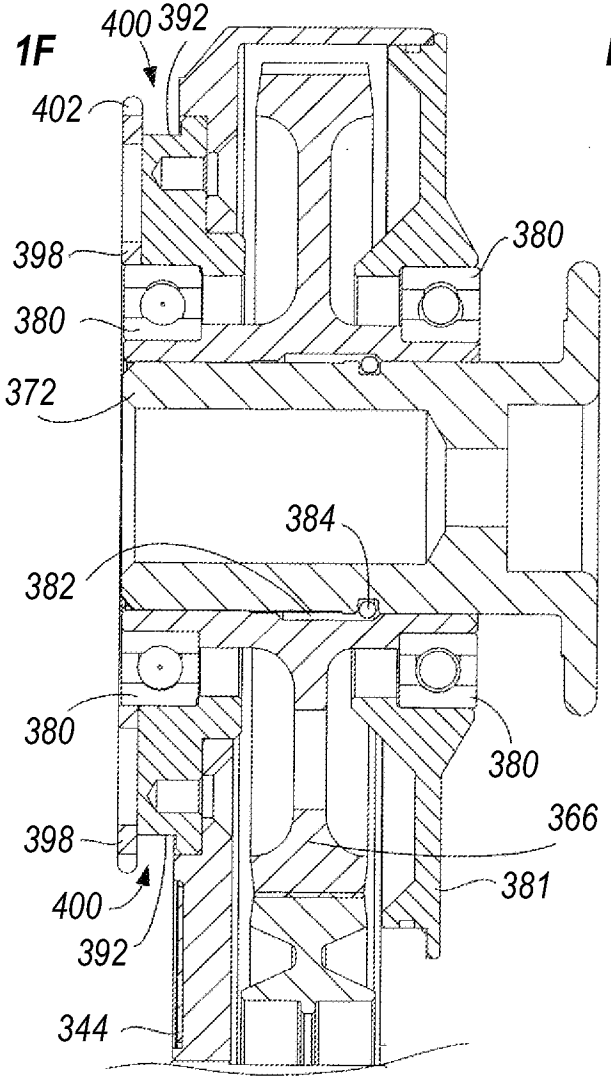
FIG. 1F is a partial cross-section of a gearbox assembly of FIG. 1E taken along line 1F-1F showing a blade or chain drive shaft ready to engage a blade flange or a chain saw gear box input gear.
Figure 1K:
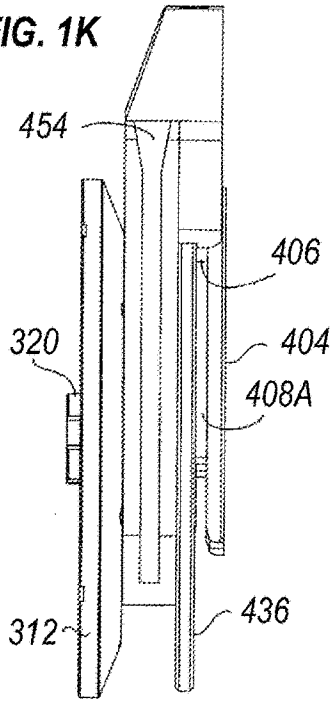
FIG. 1K is a side elevation view of the inner blade flange assembly of FIG. 1J.
Figure 1J:
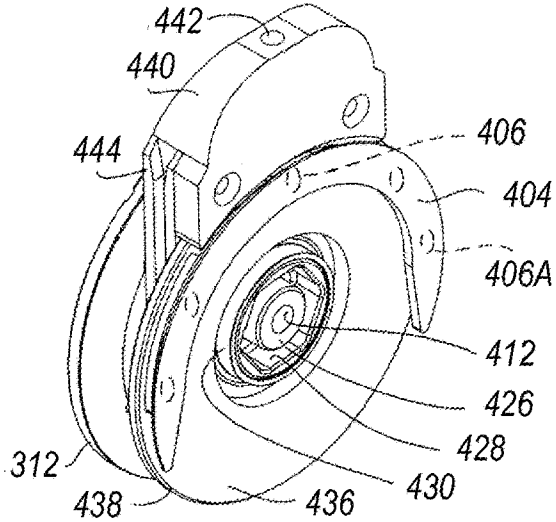
FIG. 1J is an isometric view of an inner blade flange assembly for mounting on the gearbox as shown in FIG. 1A.
Figure 1H:
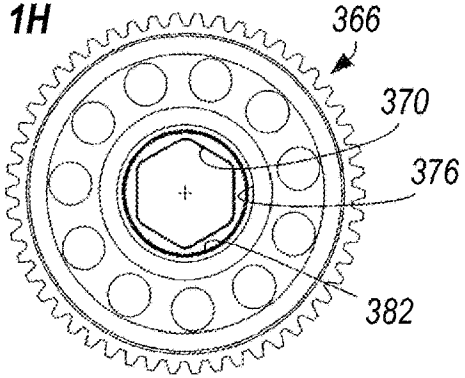
FIG. 1H is a plan view of a blade shaft stub gear for engaging and driving the blade shaft.

The medial gear drives a blade drive output gear 366 at an output portion 368 of the gearbox. The output gear 366 (FIG. 1H) is a spur gear driven by the medial gear 358. The output gear includes a non-circular drive surface 370 for turning a blade output drive shaft 372 (FIGS. 1D and 1I), and in the example shown in drawings, the drive surface 370 has a hexagonal configuration for receiving the hexagonal portion 374 on the blade drive shaft 372. The output gear also includes a substantially cylindrical support surface 376 for supporting the circular cylindrical portion 31 of the blade drive shaft. The output gear 366 is supported in the gearbox by radial bearings 380. The inner radial bearing is supported in the gearbox by a cover plate 381 mounted in the opening in the back side of the output portion 368 of the gearbox. The opening is sealed with an 0-ring in an 0-ring groove around the perimeter of the cover plate 381. The cover plate is held in place on the back of the gearbox housing through fasteners. The output gear 366 also includes an annular groove 382 in the interior surface of the gear between the hexagonal portion 370 and the cylindrical portion 376 for receiving and capturing an 0-ring 384 or other engagement element (FIG. 1F) resting in an 0-ring groove 386 in the blade output drive shaft 372. The 0-ring helps to define a limited range of axial motion of the blade drive shaft 372 when the blade drive shaft is assembled in the blade output drive gear 376. With the 0-ring in place and the drive shaft assembled with the gear, the drive shaft can travel axially between the position shown in the gearbox in FIG. 1D and the position shown in FIG. 1F, where the position shown in FIG. 1F is a retracted position for the drive shaft. In the retracted position, the arm or gearbox can more easily receive a blade flange assembly with a blade or a chain bar assembly with a chain saw cutting assembly.

The opening in the front of the output portion of the gearbox housing is covered by a cover plate 392 secured in place by six fasteners. The cover plate is received in a recess in the output portion of the gearbox. The cover plate supports the radial bearings 380, and an indexing ring 398 (FIGS. 1D and 1E-1G). Additionally, when the inner blade flange assembly of a cutting blade is being mounted on the blade drive shaft, a portion of the cover plate supports a grooved element on the inner blade flange assembly in a circumferential groove or trough 400. The circumferential groove 400 is formed between a lip on the cover plate 392 and the gearbox housing on one side, and the indexing ring 398 on the other side. The groove 400 extends around the entire circumference of the cover plate 392. As a result, the groove 400 can receive the arcuate portion (collar segment) of the inside blade flange assembly when the gearbox is at any orientation relative to the drive assembly and track. The groove can also receive an arcuate portion or support sleeve of a chain saw cutting assembly, described more fully below.

The indexing ring 398 includes outwardly extending grooves or notches 402 in the perimeter of the ring. The notches 402 are uniformly distributed about the circumference of the indexing ring 398, there being 18 notches around the circumference of the indexing ring 398 shown the drawings (the diameter of the indexing ring in the example wall saw is about 4.7 inches).

Figure 10:
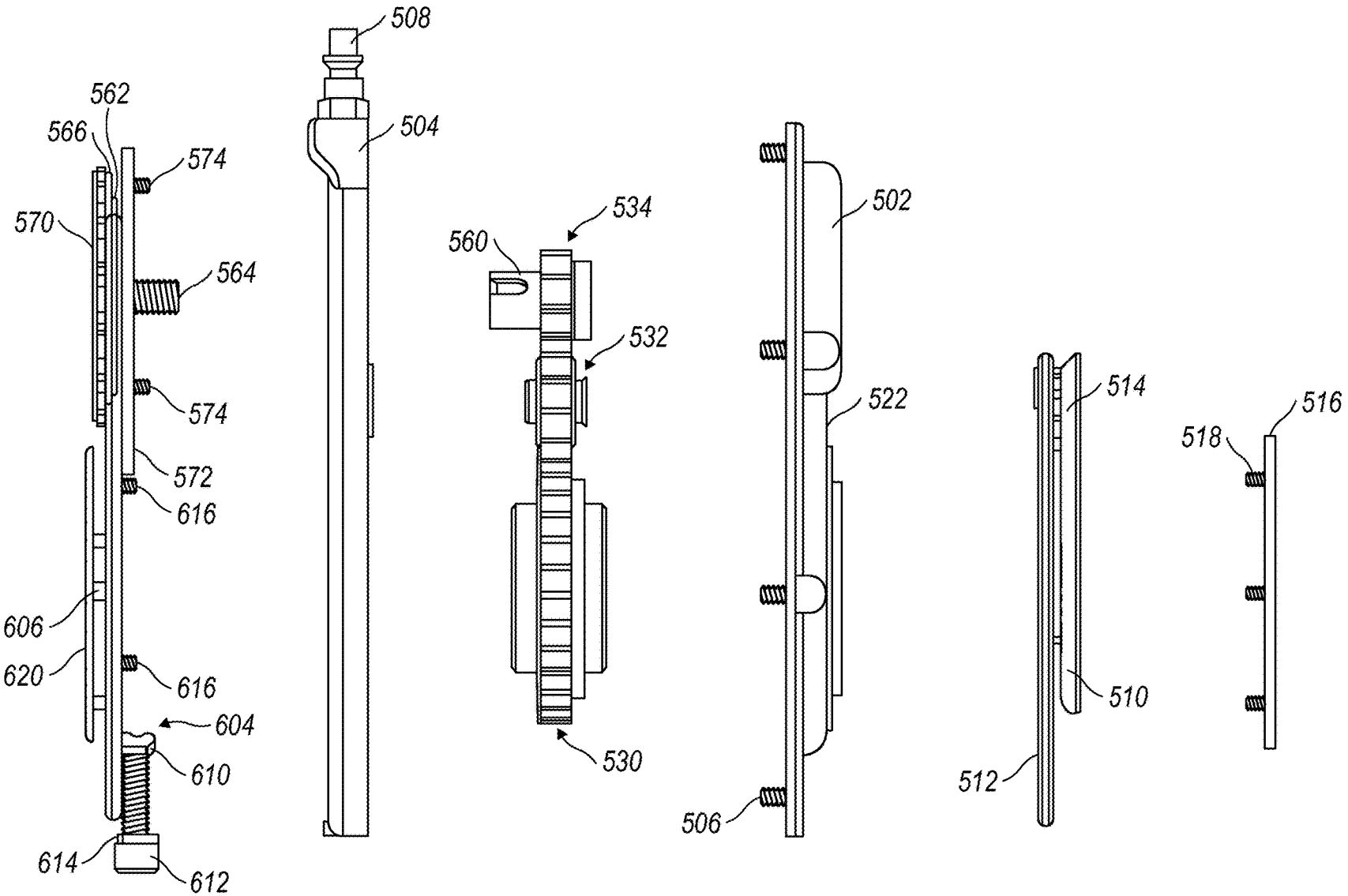
FIG. 10 is an exploded side elevation view of the assembly of FIG. 2.
Figure 12:
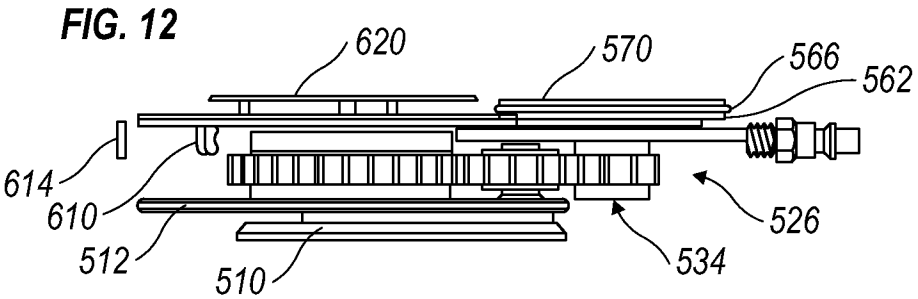
FIG. 12 is a side elevation view of the components shown in FIG. 11.
Figure 14:
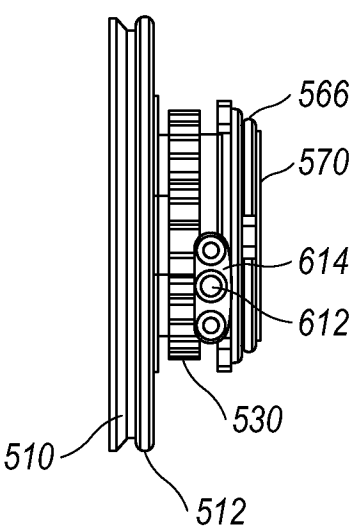
FIG. 14 is a bottom plan view of the components of FIG. 11.
Figure 13:
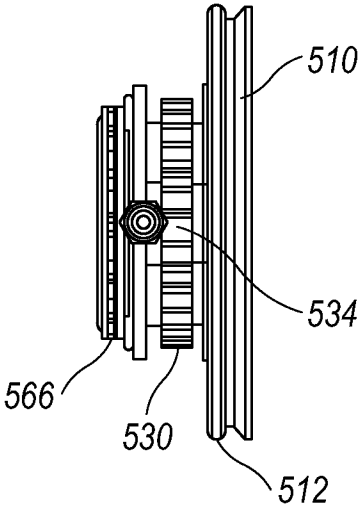
FIG. 13 is a top plan view of the components of FIG. 11.
Figure 11:
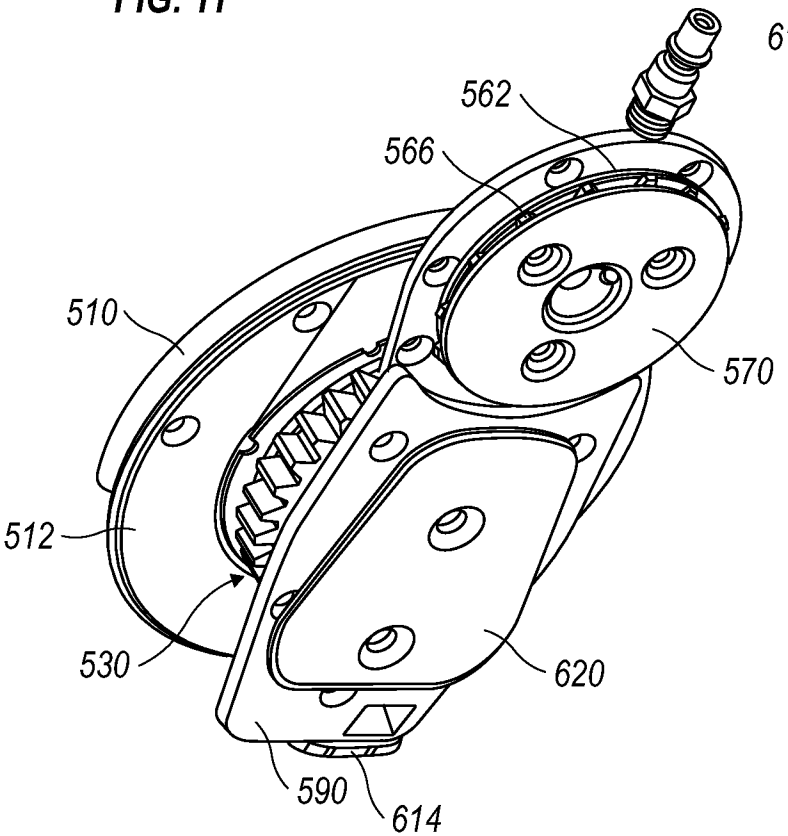
FIG. 11 is an upper isometric view of components from the assembly of FIG. 2 without housing components.
Figure 17:
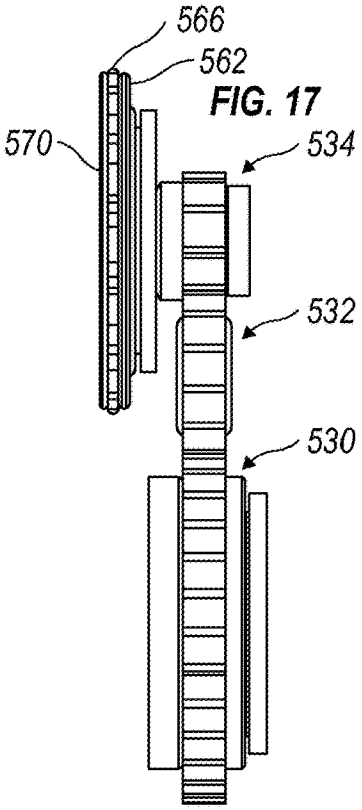
FIG. 17 is a side elevation view of the assembly of FIG. 15.
Figure 18:
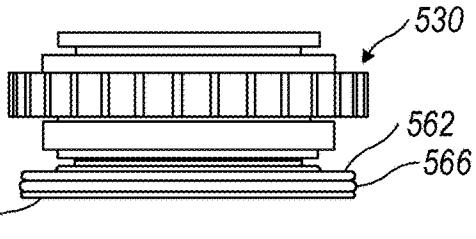
FIG. 18 is a bottom plan view of the assembly of FIG. 15.
Figure 16:
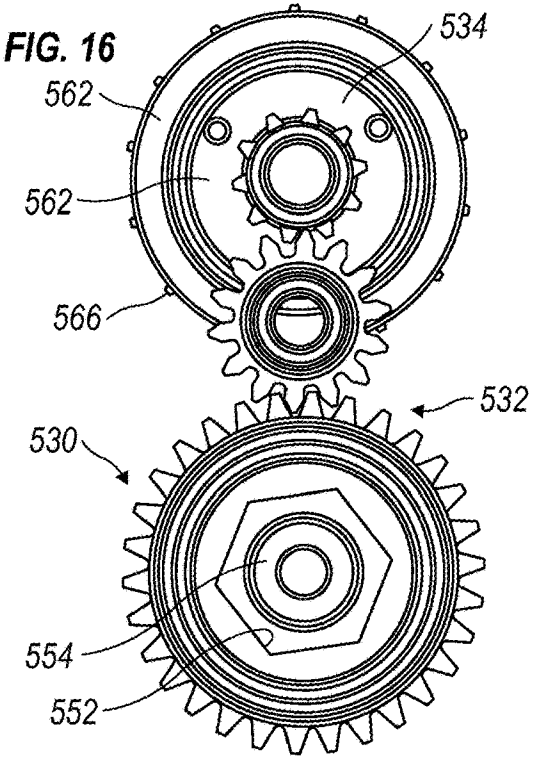
FIG. 16 is a side elevation view of the assembly of FIG. 15.
Figure 15:
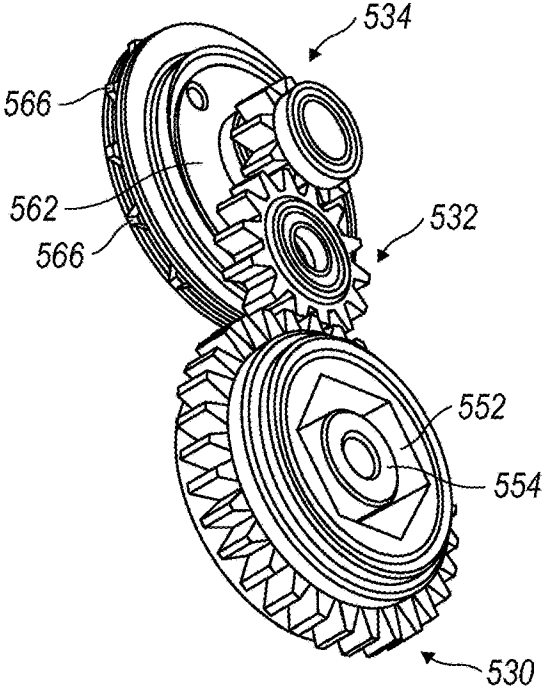
FIG. 15 is a lower isometric view of the gear train and drive sprocket assembly of the assembly of FIG. 2.

Each notch 402 is capable of receiving the side of a pin, rod, bar or other complementary structure of collar 404 on the inner blade flange assembly, or receiving a pin such as 514 on the support sleeve 510 of the chain saw assembly, described more fully below. In the example shown in the drawings, the grooved collar 404 includes a pin 406 (FIGS. 1K, 1L and 10 for engaging any one of the notches 402. In the present example, the pin is a fastener that would extend into the front face of the collar shown in FIG. 1L (though the fastener is not shown in FIG. 1L). The pin 406 also holds in place at the center of the collar 404 (the top of the collar on the Y-axis 404*y* in FIG. 1P when the collar is positioned as shown in FIGS. 1L-1O) an arcuate-extending support spacer 408, having a radius of curvature substantially the same as the radius of curvature of the indexing ring 398. Two pairs of fasteners on each side of the pin 406 also fix in place respective arcuate-extending support spacers 408A. The support spacers 408A extend in opposite directions from the pin 406, and also have radii of curvature substantially the same as that for the indexing ring 398. The ends of the spacers 408A fall almost 90 degrees from the pin 406.

Figures 1L, 1M, 1N, 1O, 1P:
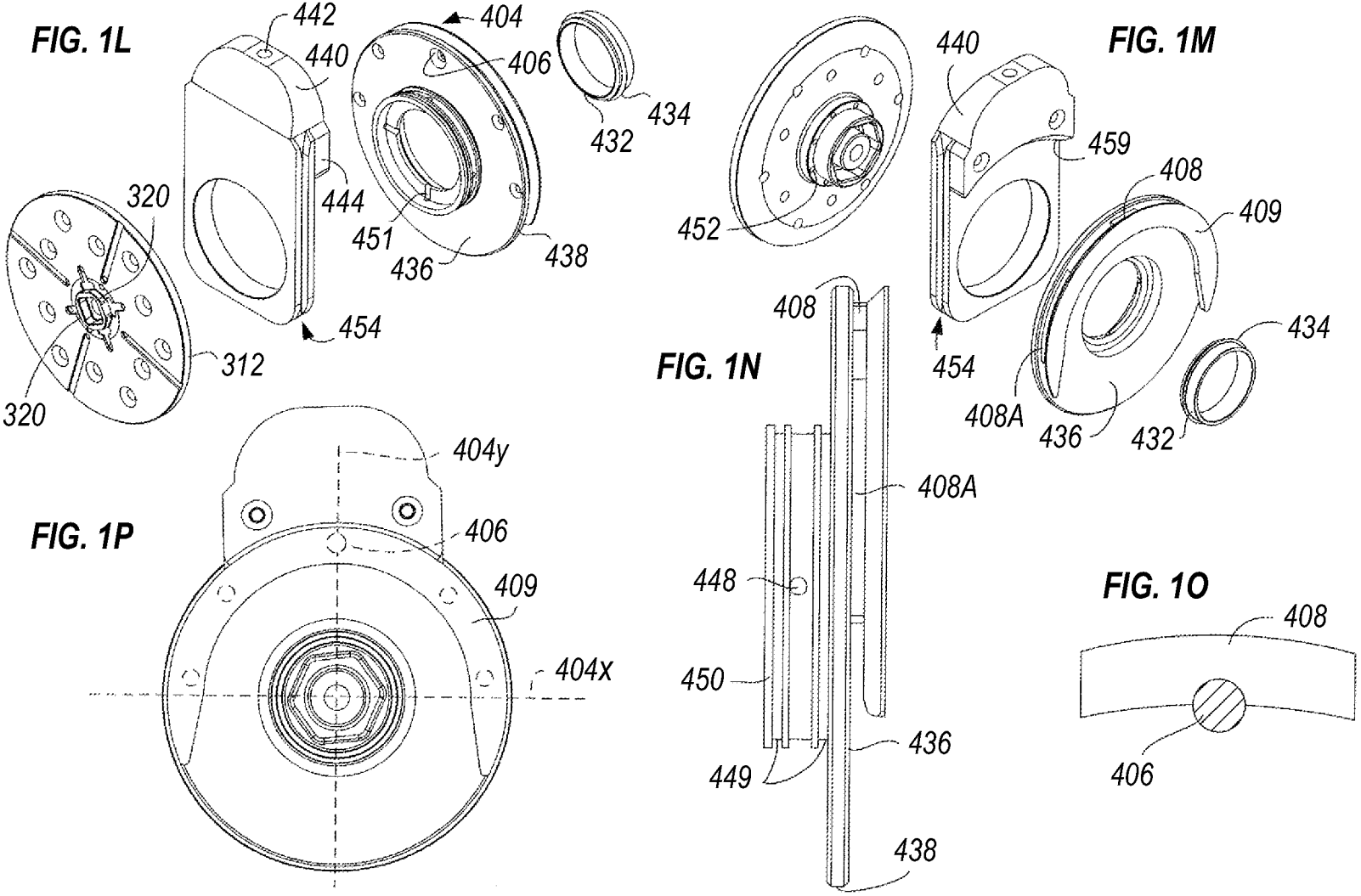
FIG. 1L is an exploded view from the left front of an inner blade flange assembly used on the blade arm of FIG. 1A.
FIG. 1M is an exploded view from the left rear of the inner blade flange assembly used 15 on the blade arm of FIG. 1A.
FIG. 1N is a side elevation view of a collar used with the inner blade flange assembly of FIG. 1P.
FIG. 1O is a front elevation view of a pin and spacer used in the collar of FIGS. 1M and 1N.
FIG. 1P is a rear elevation view of the inner blade flange assembly of FIG. 1A.
Figure 3:
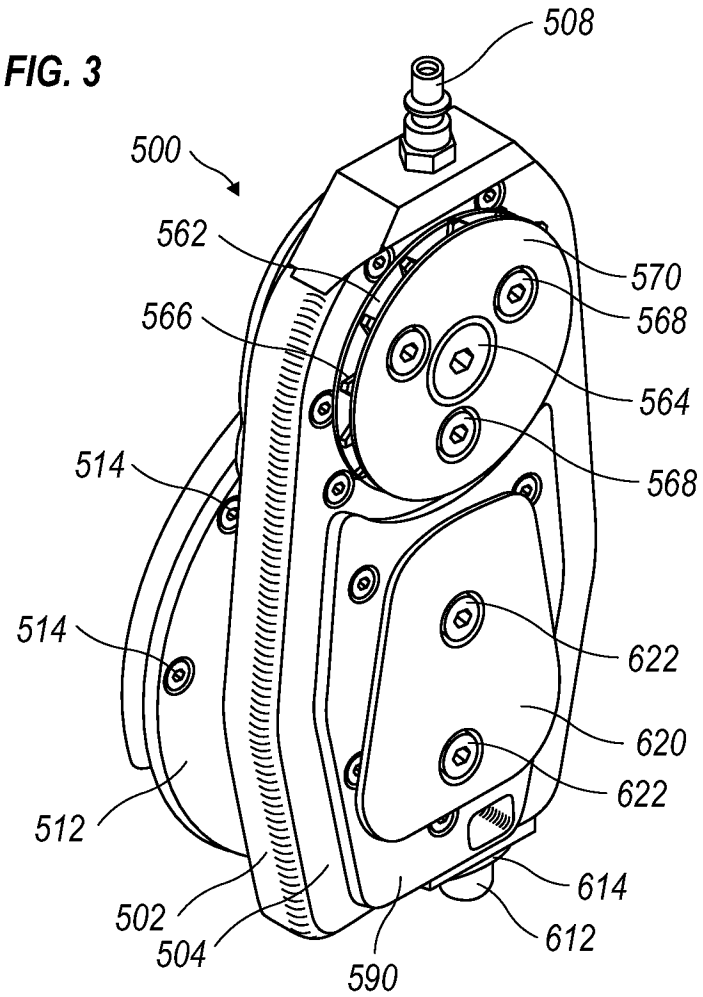
FIG. 3 is a front isometric view of the assembly of FIG. 2.
Figure 2:
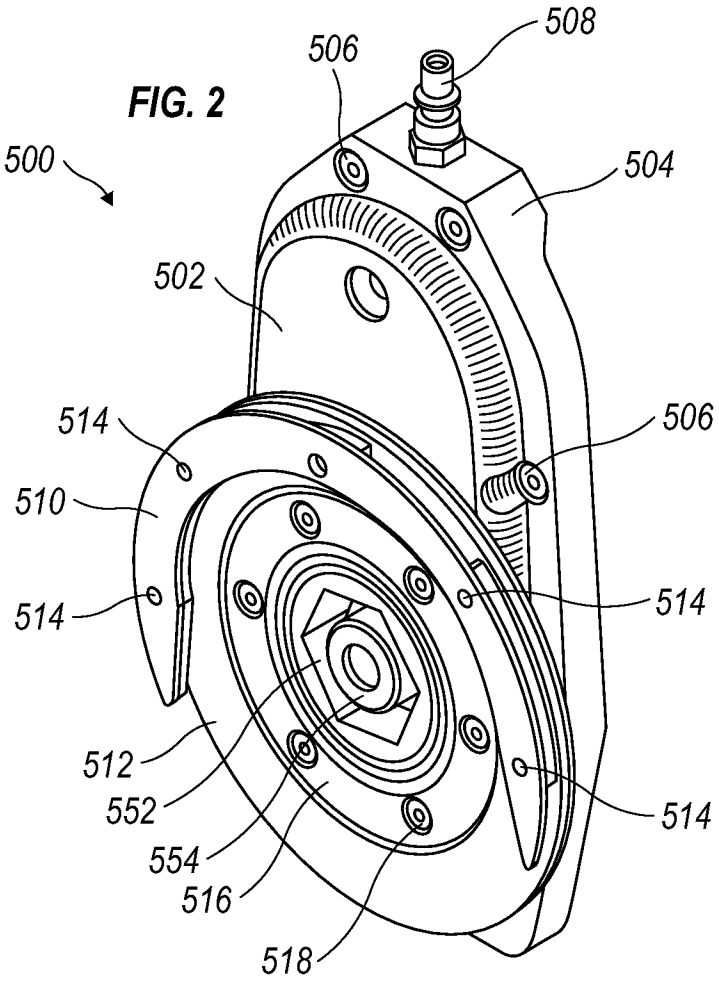
FIG. 2 is a rear isometric view of a chainsaw attachment assembly for use with a wall saw, for example that of FIG. 1 and disclosed in US Patent Publication No. 2007/0163412.
Figures 4, 5, 6, 7, 8:
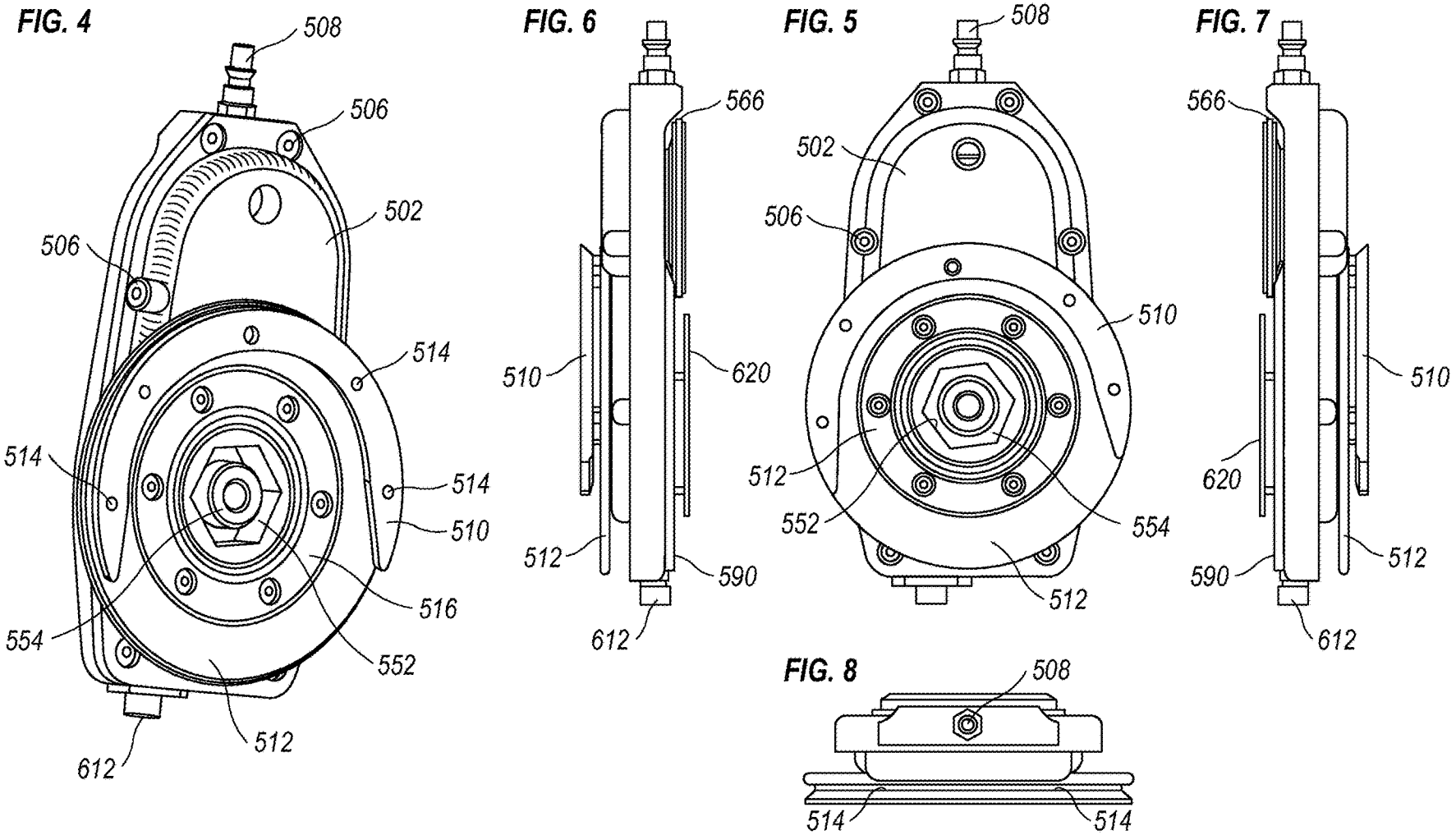
FIG. 4 is another rear isometric view of the assembly of FIG. 2.
FIG. 5 is a rear elevation view of the assembly of FIG. 2.
FIG. 6 is a right side elevation view of the assembly shown in FIG. 5.
FIG. 7 is a left side elevation view of the assembly shown in FIG. 5.
FIG. 8 is a bottom plan view of the assembly shown in FIG. 5.

The spacers support a collar segment 409 (or they may be formed integral with the collar segment) that extends in an arc over more than 180 degrees of the collar 404. As can be seen in FIG. 1P, the collar segment has a segment width that is substantially constant over 180 degrees, and thereafter decreases to a zero width at the ends of the collar segment. In the example shown in FIG. 1P the convergence of the outer and inner sides of each end of the collar segment occurs over a short distance because the inside surface of the collar segment end extends outwardly to the perimeter rather than straight down from the X-axis 404*x*. The width of the collar segment 409 is preferably greater than the depth of a notch 402, so that the collar segment extends over more than an insubstantial edge portion of the indexing ring 398. The width is preferably such as to reliably keep a blade and blade flange assembly on the indexing ring while the blade arm is stationary, allowing the operator to fix the blade flange on the blade shaft before running the blade. The overlap distance that the collar segment extends beyond the perimeter of the indexing ring may be as much as twice the depth of a notch 402, or more, but it could be less than twice. However, the exemplary collar segment extends over the indexing ring perimeter over more than 180 degrees of the ring.

When the inner blade flange assembly is placed on the blade arm, the pin contacts the circumferential surface of the indexing ring 398. At least one of the spacers 408 and 408A may also come to rest against the facing surface of the indexing ring 398. If the operator tries to shift the collar 404 of the blade flange assembly along the indexing ring, and the pin 406 is in a notch 402, then the spacers will also be resting on the adjacent circumferential edge surfaces of the indexing ring 398. If the blade flange assembly moves, it will move sufficiently so that the pin will then come to rest in a notch 402, and the blade flange assembly will then be supported on the indexing ring 398. The dimensions of the pin 406, the spacers 408 and 408A, and the size of the indexing ring 398 are such that the associated notch 402 and an arcuate portion of the circumference of the indexing ring 398 support the opposing surfaces of the grooved portion 404 which are contacting the indexing ring 398. Once supported, the inner blade flange assembly has little freedom of movement on the indexing ring 398 and the grooved portion 400. Additionally, that portion of the inner blade flange to mate with the hexagonal blade drive shaft is in alignment with the blade drive shaft, though the flats of the hexagonal shaft may not be completely aligned with the flats on the blade flange.

The blade drive shaft 372 includes a first bore 410 and a second bore 412 (FIGS. 1D and 1I) in the center of the blade drive shaft. The first bore 410 opens out to the inside portion of the blade drive shaft where a flange 414 rests against the inner bearing assembly 380 when the blade drive shaft is in the position shown in FIG. 1D. The blade drive receives a blade flange mounting bolt 416 having a bolt head 418 received in the first bore 410. The threaded portion of the bolt extends through an opening between the first bore and the second bore and extends to the end of the blade drive shaft when the head 418 of the bolt rests against the bottom of the first bore 410. In FIG. 1D, the bolt has not been fully threaded into the bore 424 of the inner blade flange, and the head 418 is not seated at the bottom of the first bore 410. The blade drive also includes a compression spring 420 between the bottom of the second bore and a retaining ring 422 on the shaft of the bolt. The retaining ring is fixed on the bolt axially, and is dimensioned so as to substantially center the bolt in the second bore 412, so that the bolt is aligned with the threaded bore 424 in the inner blade flange 312. The bore 424 is threaded the entire length of the bore. The compression spring 420 biases the bolt outward of the second bore 412 and toward the inner blade flange 312. When the inner blade flange is properly aligned with and oriented with respect to the hexagonal surfaces on the blade drive shaft 372, turning the bolt 416 threads the bolt into the threaded bore 424, drawing the blade flange into engagement with the hex surfaces on the blade drive shaft, until the blade drive shaft and the inner blade flange are fully engaged, as shown in FIG. 1D, though the bolt will be threaded further into the bore 424.

Considering the inner blade flange assembly in more detail, the blade flange 312 includes a circular boss 426 with the threaded bore 412 extending through the center of the circular boss. Spaced sideways from the outer wall of the circular boss are non-circular wall portions, in the present example a hexagonal wall 428 surrounding the boss 426. The boss 426 extends into the second bore 412 of the blade drive shaft and the threaded bore 412 receives the bolt 416. The inside surfaces of the hexagonal wall 428 slide over the hexagonal portion 374 of the blade drive shaft 372, so that the blade drive shaft can turn the inner blade flange 312. The hexagonal wall 428 includes a circular outer wall 430 for receiving a press fit metal sealing ring 432 (FIG. 1D) extending from the back side of the inner blade flange the entire axial length of the circular wall 430. When the blade flange assembly is securely mounted on the gearbox, the sealing ring 432 bears against the outer radial bearing assembly 380 and rotates with the inner blade flange 312. The sealing ring 432 includes a slanted surface 434 for sealing against a complementary corresponding surface on a stationary face plate or collar 436 (FIGS. 1D and 1J-1K) that contacts the outer surface of the indexing ring 398, as shown in FIG. 1D. The outer circumferential wall 438 of the collar 436 extends beyond the outer circumference of the indexing ring 398.

The collar 436 supports a water inlet manifold 440 (FIGS. 1D and 1J-1K) having a water inlet 442 for feeding blade cooling water to a water manifold 444. The water manifold includes at least one channel 446 feeding water to one or more collar outlets 448 between two 0-ring seal areas 449 on a water inlet ring 450 on the collar 436. The water inlet ring fits inside the complementary opening in the water manifold 444, against which the 0-rings seal. The collar outlets 448 feed the water to grooves 451 in the water inlet ring 450 and then to blade flange inlet openings 452 (FIG. 1M).

The water manifold 444 and the inlet 440 remain stationary (along with the blade guard engaging the water manifold) relative to the cutting surface, so that the water inlet manifold 440 orientation remains substantially the same with rotation of the gearbox relative to the drive assembly. The water inlet manifold 440 and the water manifold 444 can rotate about the 0-ring seals 449 during rotation of the blade arm/gearbox. The outside of the water manifold 444 includes grooves 454 for receiving complementary structures associated with a blade guard, which also help to maintain the orientation of the water manifold and blade guard even while the blade arm/gearbox rotates relative to the cutting surface. Lip seals 456 are included in the output portion of the gearbox and the inner blade flange assembly for sealing the adjacent structures.

When the drive assembly and associated gearbox are properly mounted on the track, a blade and blade flange assembly can be mounted on the blade arm/gearbox. A blade is first mounted on the blade flange assembly. In the case of a flush cut operation, the blade is fastened to the inner blade flange through appropriate fasteners into the face of the inner blade flange. In other cutting operations, the blade 114 is mounted between the inner and outer blade flanges, using a bolt threaded into the outer end of the threaded bore 424 in the inner blade flange. The inside of the surface 320 on the inner blade flange engages the outside of a complementary surface on the inside of the outer blade flange to reduce the tendency of blade rotation to unthread the blade mounting bolt from the threaded bore 424.

The blade drive shaft 372 is then pressed flush with the outer portion of the gearbox, either manually or by pressing the blade and blade flange assembly against the drive shaft, so that the drive shaft is positioned as shown in FIG. 1F. The blade and blade flange assembly is then moved sideways into engagement with the indexing ring 398 so that the pin 406 engages a notch 402, either directly or after shifting the collar and blade flange assembly in one direction or the other until the pin 406 engages a notch. In one configuration, the pin 406 is placed in the vertically upper-most notch 402 or either of its two adjacent notches for the given blade arm/gearbox orientation. The blade and blade flange assembly can be moved into engagement with the indexing ring 398 for any angular position that the blade arm/gearbox is found in. With 18 notches in the circumference of the indexing ring, the pin 406 can easily be positioned in an upper-most notch. If the pin happens to rest outside of a notch, the blade can be moved several degrees in one direction or the other until the pin comes to rest in a notch.

Because of the angular distribution of the notches 402, the hex surfaces of the drive shaft 72 may align with the hex surfaces 428 on the blade flange assembly. Proper alignment can be checked by pressing on the flange 414 of the blade drive shaft 372. If the hex surfaces are aligned, the blade shaft will engage the blade flange assembly and advance a small amount, and the blade shaft flange will turn in the operator's hand with the blade. The bolt 416 is then threaded into the bore 424. If the hex surfaces are not aligned, the operator can grasp the blade and rotate it a few degrees until the blade shaft can be pressed into engagement with the blade flange assembly, after which the blade shaft flange will turn with the blade. The bolt 416 is then threaded into the bore 424. In one configuration, the bolt length is such that it will not thread into the bore 424 until the hex surfaces on the drive shaft extend partly along the hex wall 428 in the blade flange assembly. In another configuration, the bolt end is such that it can begin threading without advancing the blade shaft. In a further configuration, the bolt can begin threading before the drive shaft and flange are completely engaging. In the present example shown in the drawings, the bolt is configured to have its threaded end flush with the drive shaft end before the blade flange is placed on the blade arm. The spring 420 helps to bias the bolt 416 into engagement with the threads in the bore 424 of the blade flange assembly, so when the hex surfaces are aligned, the bolt can be threaded into the blade flange. While the operator is engaging the blade drive shaft with the flange assembly, the indexing ring 398 and the groove 400 support the blade and blade flange assembly. Therefore, the operator's hands are free to securely mount the blade and blade flange assembly on the saw.

In some cutting situations, the saw may be arranged so that the arm is below the saw, and it is difficult to place the blade flange assembly on the upper-most surface of the indexing ring. For example, the wall saw may be mounted close to a ceiling that precludes raising the blade and blade flange assembly high enough to place the collar on an upper portion of the indexing ring. The operator may then orient the blade flange assembly so that the open end of the collar segment is directed upward. The assembly including the collar is then moved against a lower portion of the indexing ring until the pin 406 engages a notch. The water manifold 444 (and the water inlet manifold 440) is then pivoted until the water inlet manifold is substantially diametrically opposite the pin 406. In that orientation, the arcuate rim 459 on the water inlet manifold faces the collar segment, and between them substantially surround the indexing ring. The blade and blade flange assembly is then substantially prevented from coming off the indexing ring as long as the diametrical spacing between the inner edge of the collar segment and the inner edge of the arcuate rim 459 is less than the diameter of the indexing ring. While gravity will pull the collar plate away from the indexing ring 398, the arcuate rim 459 stops the collar from falling free of the indexing ring, and specifically, the ends of the collar segment will still help to hold the blade flange assembly in place.

When cutting is complete, or to change blades, the saw is turned off and the blade allowed to stop. The bolt 416 is backed out and the blade shaft removed from the hex wall 428. When the blade shaft is free of the blade flange, the blade and blade flange assembly can be removed by lifting the assembly from the indexing ring and the groove 400.

In the present example of a concrete cutting assembly for circular blade cutting or chain sawing, the cutting assembly includes an interface configured to removably receive the cutting blade and also to removably receive a cutting chain assembly. In the present example, the interface on the arm of the wall saw can receive a cutting blade mounted on an inner blade flange assembly configured to be complementary to the interface. Additionally, the interface can receive the chainsaw cutting assembly also configured to be complementary to the interface. Other cutting elements can also be configured to have structures complementary to the interface so that such cutting elements can be supported and driven by the wall saw arm. In the present example, the interface includes the plate or planar element that forms the indexing ring 398 and the engagement portion of the driveshaft 372. The indexing ring 398 supports the collar 404 for the cutting blade or the support sleeve 510 on the assembly. The indexing ring can take a number of other configurations other than planar, other than circular and other than with arcuate grooves or notches 402, with suitable changes in the structures of the assembly and cutting blade assembly so that the interface can reliably support those assemblies. Also in the present example, the engagement portion of the driveshaft has a hexagonal surface geometry for engaging complementary hexagonal surfaces on the cutting blade assembly and on the chain bar gearbox assembly. It also includes a threaded bolt for securing the cutting blade or chain bar assembly to the wall saw arm. As with the indexing ring, the engagement portion of the driveshaft can take a number of configurations other than hexagonal or flat surfaces and a bolt for securing the assemblies on the wall saw arm. However, the present examples will be described in the context of the interface having the planar and notched indexing ring 398 and axially movable, hexagonal-profiled driveshaft 372 with a threaded bolt for securing the assemblies on the wall saw arm.

Wall saw cutting, for example for cutting a line in concrete such as for an opening in a wall, has been described in the US Patent Publication. For purposes of discussion, it will be assumed that the wall saw is set up for blade cutting, as described in the US Patent Publication. However, for purposes of the structures described herein, the wall saw can be set up and used initially as a chain saw cutting assembly, as would be apparent to one skilled in the art after considering the discussion herein. Therefore, wall saws configured as described herein can be used as cutting blade saws and then the blade exchanged for chain saw cutting or vice versa, or used exclusively as a blade cutting assembly, as described in the US Patent Publication or as a chain saw cutting assembly as described herein.

Assuming for purposes of discussion only that the wall saw is first set up for blade cutting, the saw blade is removed to exchange or fit for chain saw cutting. The wall saw blade can be removed either separately or at the same time as the blade flange assembly, including the inner blade flange 312 and its mounting assembly. To do so, the blade flange mounting bolt 416 is unthreaded and the blade output driveshaft 372 withdrawn, retracted or recessed into the gearbox. A chainsaw cutting assembly 500 (FIGS. 2-32) including a chain bar, cutting chain and nose sprocket (as understood by those skilled in the art, but not shown in FIGS. 2-32) is slid over the indexing ring 398 so that one or more of the pins engage the notches 402 in the indexing ring 398. After proper registration with the notches, the blade flange mounting bolt 416 is advanced to thread into a corresponding threaded bore (described more fully below) and the blade output driveshaft 372 engages with a corresponding receiver (also discussed more fully below) on the chainsaw cutting assembly 500. The chainsaw can then be operated as desired.

The chainsaw cutting assembly 500 (FIGS. 2-10) generally includes an inner housing 502 and an outer housing 504, which may be cast aluminum parts. The housings 502 and 504 may be fastened together through appropriate fasteners, such as fasteners 506. A water inlet fitting 508 is mounted to the top of the outer housing for receiving a coolant hose 509 and supplying cooling water or other fluid to the chain bar (described below).

The chainsaw cutting assembly 500 includes, in the present example for use with the wall saw described in US Patent Publication 2007/0163412, an interface for engaging and being supported by the wall saw interface. In the present example, the interface includes at least one structure that is complementary to a structure on the interface of the wall saw arm. In the present example, the interface includes a shoe or support sleeve 510 mounted to a face plate, swivel or collar 512. The support sleeve is mounted to the collar through appropriate fasteners 514. The fasteners 514 also serve as registration points for the notches 402 in the indexing ring 398 of the wall saw, in a manner similar to the assembly shown and described with respect to FIG. 32 of the US Patent Publication. The shoe 510 and the other components mounted to the collar 512 are selected so as to be substantially identical to those for the wall saw blade interface used to mount the blade to the wall saw so that the chainsaw assembly is interchangeable there with.

Figure 9:
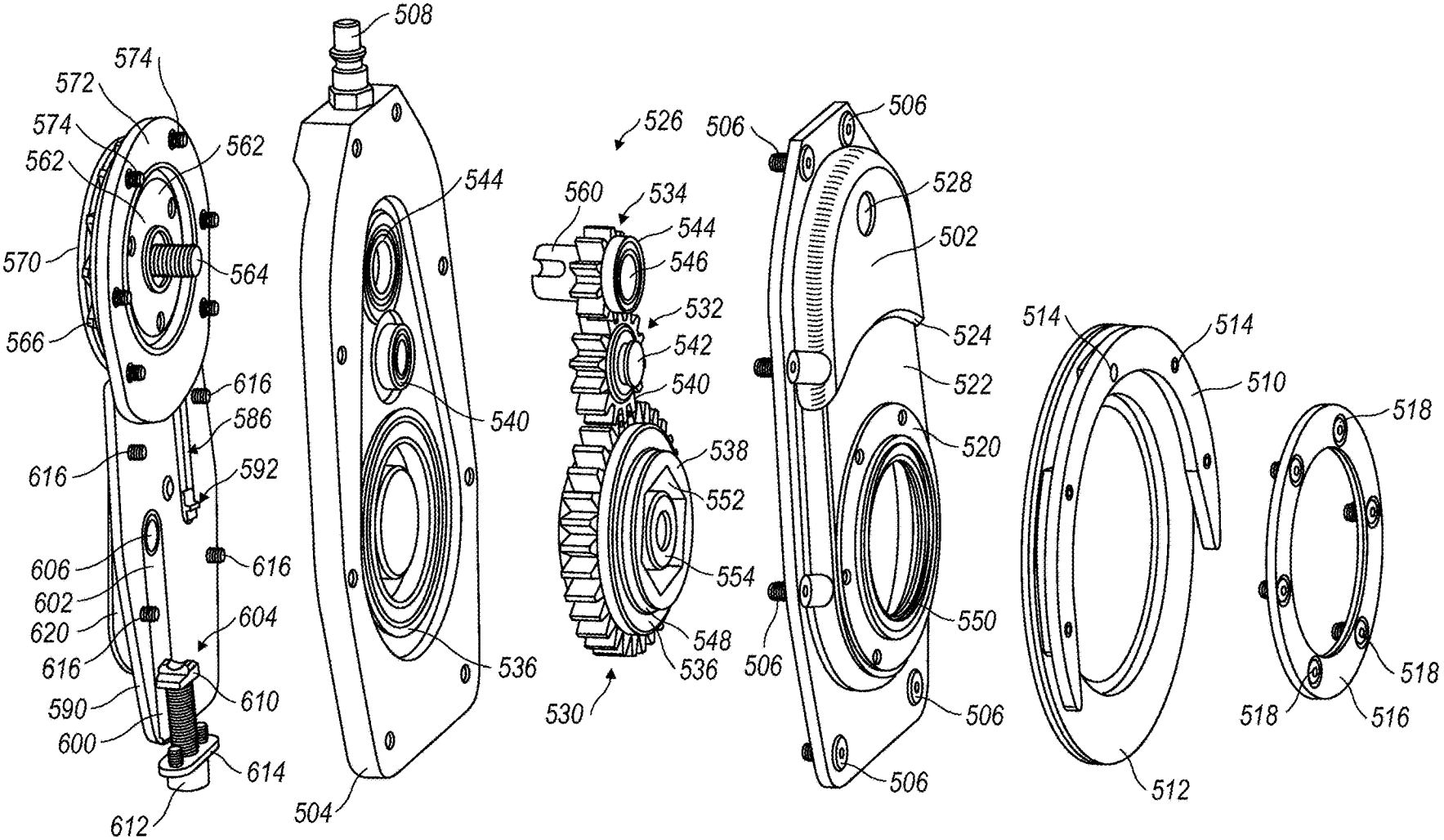
FIG. 9 is an exploded isometric view of the assembly of FIG. 2.

The collar 512 is supported by the inner housing 502 through a retaining ring 516 and its fasteners 518 to allow the collar 512 to pivot or rotate relative to the rest of the chainsaw cutting assembly 500. The retaining ring 516 is secured to and rotatably fixed relative to the inner housing 502 at a circular boss 520 (FIG. 9). A NylaTron wear plate 522 (FIGS. 9-10 and 19-21) extends around the outermost perimeter of the boss 520 and up to a concave surface 524 in the inner housing 502 to protect the inner housing in the area of collar 512.

The chainsaw cutting assembly 500 can be mounted on the arm or gearbox of the wall saw described in the US Patent Publication. To be mounted on a different wall saw design, the collar assembly 512 (and the shoe 510 and fasteners 514) might be modified to accommodate a different supporting configuration on the wall saw interface corresponding to the particular wall saw to which the chainsaw cutting assembly is attached. Additionally, the input gear described more fully below may also be reconfigured to accommodate the particular blade driveshaft or other output configuration of the particular wall saw.

The inner and outer housings contain and support a gear assembly or gear train 526 (FIG. 9) and lubricant, which may be filled or exchanged through an opening 528 in the inner housing wall 502 after removal of a suitable plug or stop (not shown). The gear train is configured to convert the output of the wall saw at the blade driveshaft to the input of the chainsaw as would be conventional for the chainsaw configuration desired. In the present example, the gear train up-converts the RPM; for example it converts the 1500 RPM output at the blade driveshaft to about 5000 to 5800 rpm or more. In the present example, the RPM is approximately tripled or four times the starting rpm. Other configurations are possible. The gear train 526 includes an input gear 530 driven by the driveshaft 372 (FIG. 1F), such as the blade output driveshaft 372 in the US Patent Publication. The input gear drives a medial gear 532 which in turn drives output gear 534. The input gear is supported by respective bearings 536 in the inner and outer housings 502 and 504, respectively. The input gear is supported about a periphery of an input gear shaft 538. The medial gear is supported by respective bearings 540 on the medial gear shaft 542, and the output gear is supported by respective bearings 544 on the output gear shaft 546. These bearings are supported in respective cavities in the respective housings.

In the present example, the gear train is configured to fit in a relatively small envelope within the housings. This permits the chain bar assembly to operate in a flush cut fashion. It also permits the chain bar assembly to more easily operate in the cutting envelope of the wall saw with which the chain bar assembly is used. Additionally, this makes easier the assembly of the chain saw assembly on to the wall saw arm so that the chain bar aligns with the desired cutting line without additional adjustment or positioning. Alternatively, other configurations can have larger envelopes, larger housings or other configurations, for example if flush cutting was not considered necessary. The up-conversion gear assembly allows the chain bar gearbox to be mounted to the wall saw arm and driven by the driveshaft configured for a wall saw for also operating the chainsaw. Therefore, with appropriate interface configurations on the chainsaw assembly, the chainsaw assembly can be mounted to an appropriate (for example suitably complementary) interface on an arm such as that for a wall saw for chainsaw cutting. Therefore, chainsaw cutting, for example for corner cutting an opening, can be easily and quickly accomplished using already installed and operating equipment, using the same power supply, and controls, and without having to align the chainsaw in a cut that may have been previously formed by a cutting blade. In appropriate configurations, the same water supply can be used as well. Additionally, having the chainsaw assembly mounted on a pivoting arm of a wall saw or comparable equipment allows wide flexibility in positioning the chainsaw for plunge cutting, corner cutting and other applications.

The input gear shaft 538 includes an outer circumferential surface 548 that extends through an opening in the boss 520 of the inner housing 502 (FIG. 9). The input gear shaft 538 is sealed within the opening by a seal 550. The input gear shaft 538 is accessible through the opening so that the wall saw blade driveshaft can engage and be secured to the input gear.

The exposed portion of the input gear includes a plurality of surfaces, in the present example hex surfaces 552 (FIGS. 2, 4, 5, 9, 15-16 and 25-26). The hex surfaces 552 are formed in a cavity extending into the input gear shaft 538. A boss 554 extends in the center of the cavity so that the blade flange mounting bolt 416 in the wall saw of the US Patent Publication can secure the blade output driveshaft 372 to the input gear 530. The boss 554 is internally threaded to be complementary to the blade flange mounting bolt. If the chain saw assembly is to be mounted to a blade output configuration different than that in the US Patent Publication, the input gear may be modified to accommodate a different wall saw blade output configuration.

Figure 20:
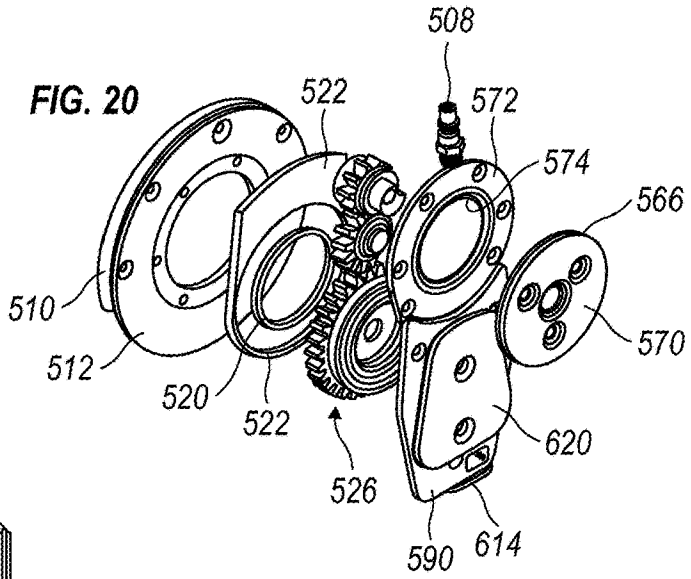
FIG. 20 is an upper front isometric exploded view of FIG. 19.
Figure 21:
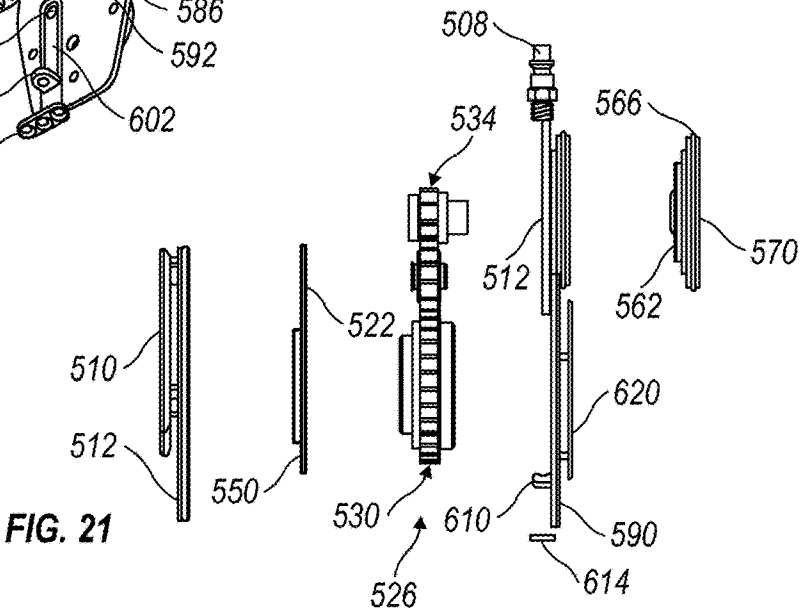
FIG. 21 is a side elevation exploded view of the components of FIG. 19.
Figure 19:
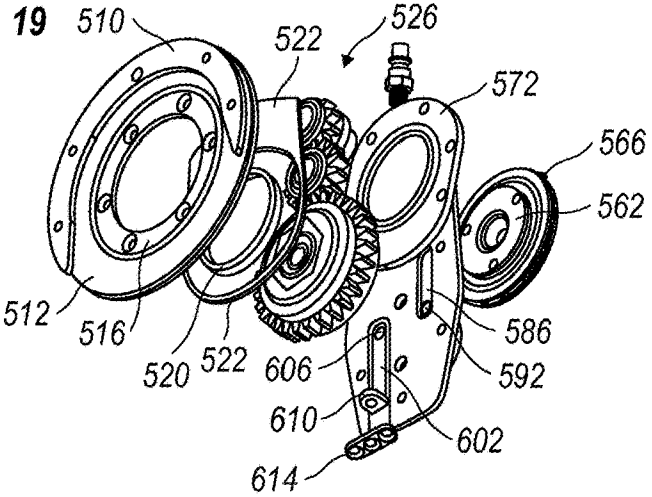
FIG. 19 is a lower rear isometric exploded view of components of the assembly of FIG. 2.
Figure 22:
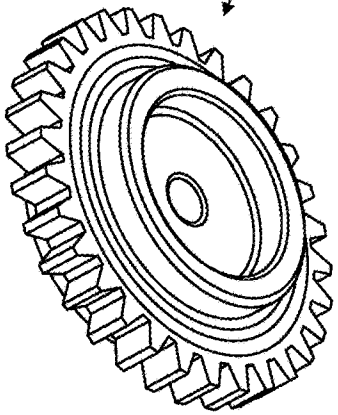
FIG. 22 is a front isometric view of an input gear for the assembly of FIG. 2.
Figure 23:
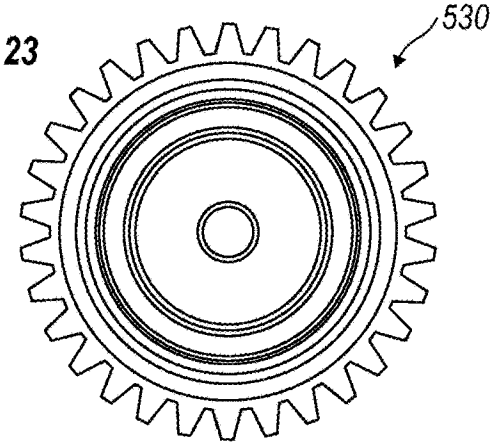
FIG. 23 is a front elevation view of the gear of FIG. 22.
Figure 24:
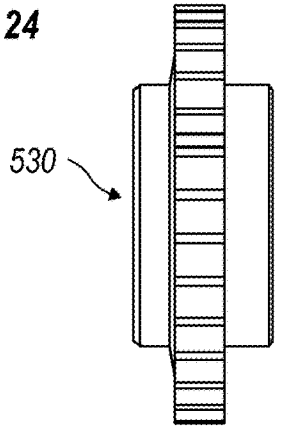
FIG. 24 is a side elevation view of the gear of FIG. 22.
Figure 25:
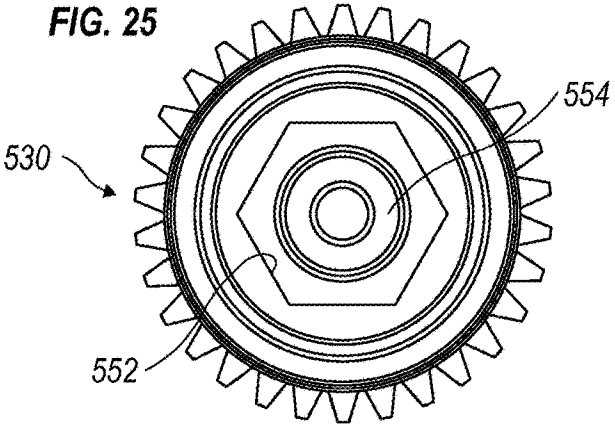
FIG. 25 is a rear elevation view of the gear of FIG. 22.
Figure 26:
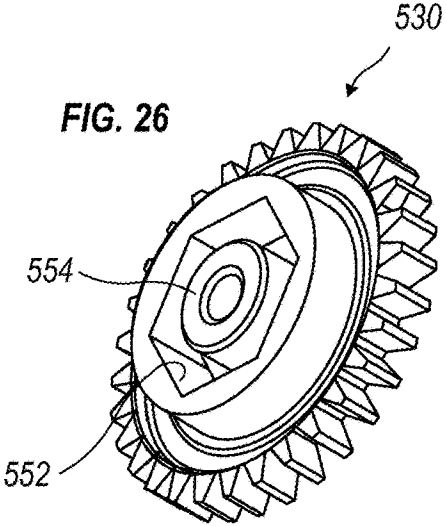
FIG. 26 is a rear isometric view of the gear of FIG. 22.

The output gear 534 includes an output shaft 560 that extends through the outer housing 504 to a drive plate 562. The output shaft 560 and the drive plate 562 include key ways for accepting a key (not shown) so that the output shaft drives the drive plate 562. A bolt 564 secures the drive plate to the output shaft 560 by threading into the interior of the drive shaft 560. In the present example, three shear pins (not shown) are press fit into the outer side of the drive plate 562. The corresponding close-fitting openings in a chain drive sprocket 566 fit over the shear pins, which also serve to register the drive sprocket. Each pin is located equidistant between the other pins and between respective adjacent mounting bolts 568 on a circle connecting the mounting bolts 568. The chain drive sprocket 566 is keyed to the drive plate 562 only, and the pins are used for registration and shear strength. The mounting bolts 568 clamp the drive sprocket to the drive plate. The pins and mounting bolts 568 are distributed evenly about the circle to support the drive sprocket 566. The mounting bolts 568 clamp a retaining plate 570 to the drive plate 562 through openings in the drive sprocket 566. The mounting bolts 568 allow easy removal of the retaining plate 574 for easy replacement of the drive sprocket or substitution of other drive sprockets 566 as desired. The mounting bolts 568 are removed, the retaining plate 574 removed and then the drive sprocket slipped off the shear pins. Another drive sprocket can then be slipped over the shear pins, and the retaining plate reinstalled and secured by the mounting bolts 568. The drive plate 562 is sealed in an opening in a water seal cover 572 by a seal 574 (FIG. 20). The water seal cover 572 is secured to the outer housing 504 by fasteners 574.

Figure 29:
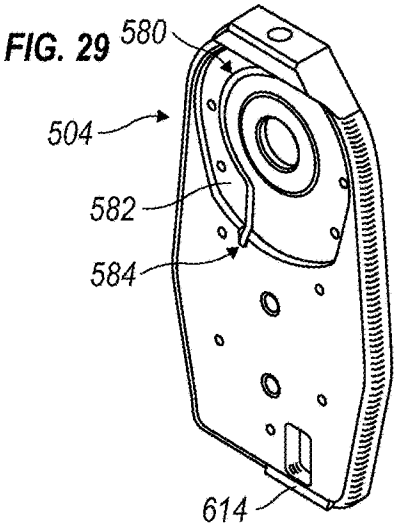
FIG. 29 is an outside upper isometric view of an outside housing member or casting for the assembly of FIG. 2.
Figure 32:
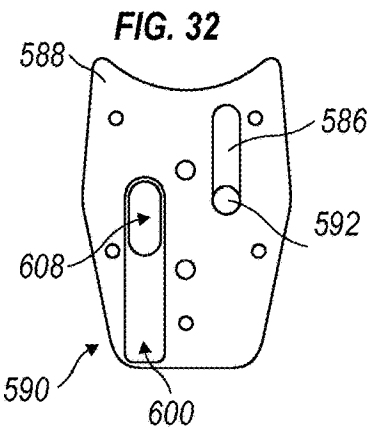
FIG. 32 is a rear elevation view of the wear plate of FIG. 31.
Figure 31:
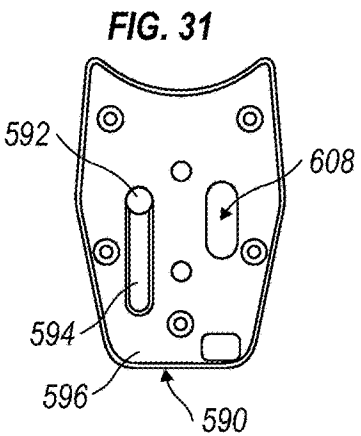
FIG. 31 is a front elevation view of a wear plate to be mounted to the front of the housing member of FIG. 30.
Figure 30:
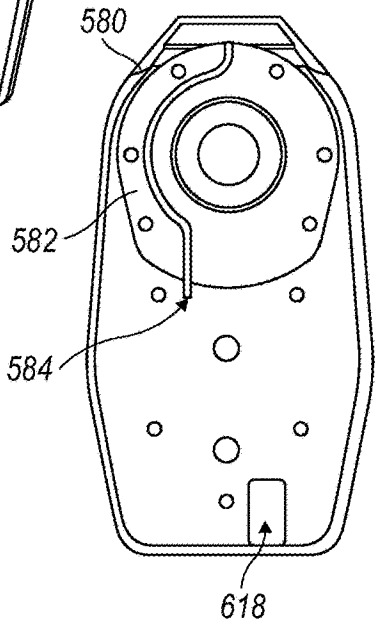
FIG. 30 is a front elevation view of the housing member of FIG. 29.
Figure 27:
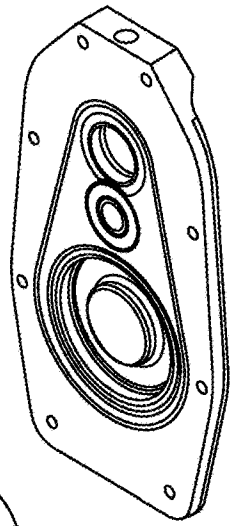
FIG. 27 is an inside upper isometric view of an inside housing member or casting for the assembly of FIG. 2.
Figure 28:
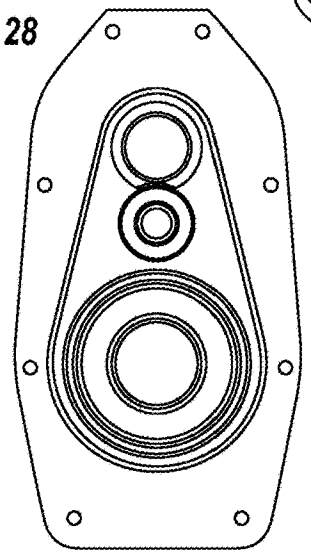
FIG. 28 is a rear elevation view of the housing member of FIG. 27.

A water channel 580 is formed in the present example, such as by milling, on the outer surface 582 of the outer housing 504 (FIGS. 29 and 30). The water channel supplies water or other cooling fluid from the inlet fitting 508, through the top of the outer housing 504 to a channel terminus 584. The water then goes from the terminus into a first water channel 586 on an underside 511 of a wear plate 590 (FIGS. 9 and 32). In the present example, wear plate is formed from 303 stainless steel and covers the lower portion of the outer housing 504. The first water channel 586 extends from an upper portion of the wear plate to an opening 592 extending completely through the wear plate 590. The opening 592 allows the water to flow from the inside of the wear plate adjacent the outer housing 504 to the outside of the wear plate and into a second water channel 517 extending along the outer surface 596 of the wear plate so that the water can feed into an inlet opening in a chain bar (not shown). The second water channel 517 extends a significant distance along the wear plate to account for longitudinal adjustment of the chain bar for tensioning the cutting chain.

The wear plate 590 also includes a channel 600 on the inside surface 511 for receiving a slide bar 602 of a tensioning mechanism 604 (FIGS. 3-7, 9-12, 14, 19-21 and 30-32). The tensioning mechanism 604 allows tensioning of the cutting chain through longitudinal movement of the chain bar, as is known to those skilled in the art. In the present example, the tensioning mechanism 604 includes the slide bar 602 resting and moving longitudinally in the channel 600.

The slide bar is fixed to a button, knob or boss 606 (FIGS. 9-10) extending through an opening 608 (FIGS. 31-32) through the wear plate 590. In the present example, the opening 608 is substantially oval allowing the boss 606 to move longitudinally in the opening with movement of the slide bar 602.

A flange 610 (FIGS. 9-10, 12, 19 and 21) is fixed to the slide bar 602 and moves the slide bar longitudinally through threading of an adjustment bolt 612 rotatably held in a support bracket 614 on the external surface of the bottom of the outer housing 504. The adjustment bolt 612 rotates freely within the support bracket 614, and the flange 610 has complementary internal threads so that rotation of the adjustment bolt 612 moves the flange 610 along the threads of the bolt. In this configuration, the cutting chain tensioning mechanism is substantially contained within the cavity formed between the wear plate 590 and the outer surface of the outer housing 504. The wear plate 590 is mounted to the outer housing through appropriate fasteners 616. The flange 610 and the shank of the bolt 612 are positioned in a cavity 618 in the outer housing (FIG. 30).

A chain bar mount 620 (FIGS. 3, 6, 7, 9-12 and 20-21) and is mounted through fasteners 622 (FIG. 3) to be spaced apart from the wear plate 517 mounting the chain bar, as is understood to those skilled in the art. The chain bar mount has a substantially trapezoidal outline for supporting the chain bar. In another example of a chainsaw cutting assembly, a chainsaw cutting assembly 700 (FIGS. 33-44) includes identical or comparable components to those described above with respect to the assembly 500, and the same or similar structures have identical numbers where the structures and functions are substantially identical, and structures having the same or similar functions have identical numbers with the suffix (A) where the geometries have been modified. For example, a wear plate 590A (FIG. 33) is included in the assembly, just as the wear plate 590 (FIG. 3) is used in the assembly 500, with the same function and may have the same material, but with a different geometry. In this example, the chainsaw cutting assembly 700 is shown without the driving and supporting equipment, such as a wall saw, carriage and track, but it will be understood that the chainsaw assembly 700 can be configured and implemented on such a wall saw in a manner similar to the assembly 500 described above.

Figure 44:
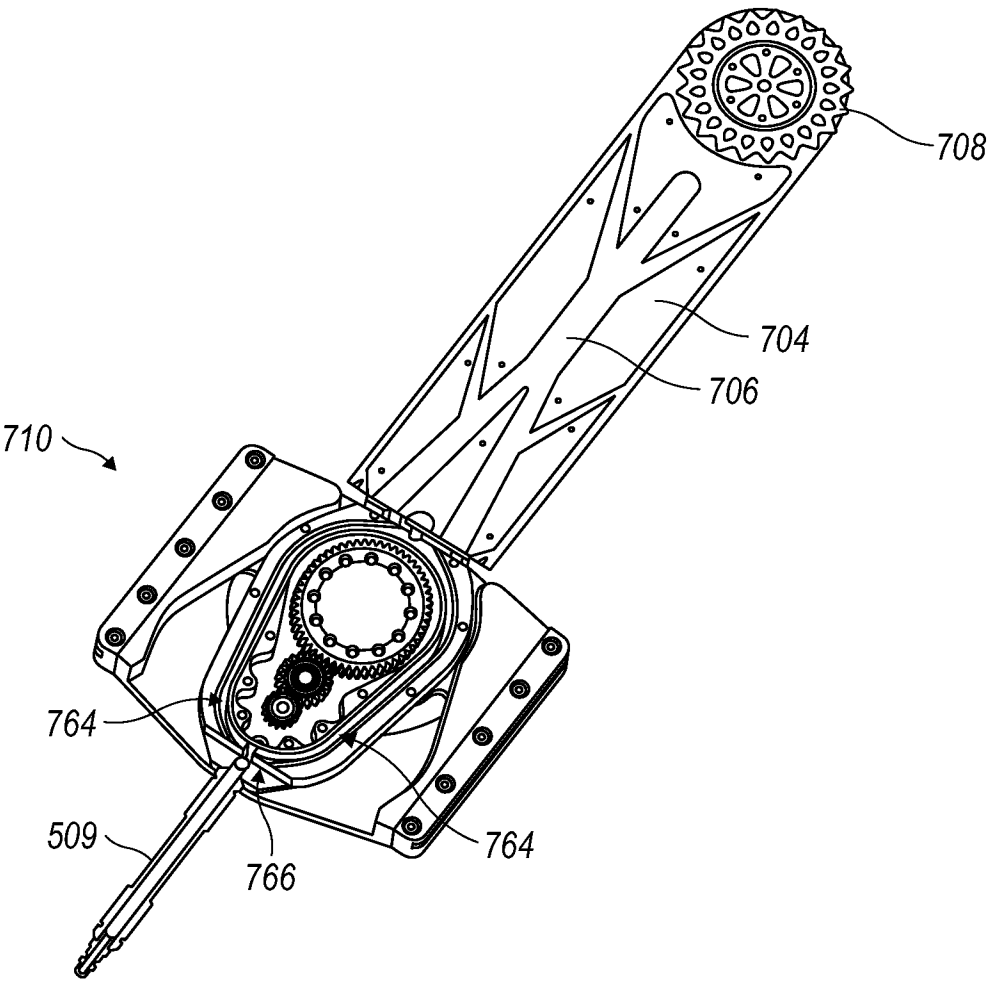
FIG. 44 is an upper isometric and partial cutaway view of the chainsaw assembly and guard support of FIG. 33.

In the present example, the chainsaw assembly is illustrated with what would be considered a conventional chain bar 702, which is a laminate or sandwich of structural materials having first and second outside layers for wear protection and structural support. A laminate also includes an internal structural support in the form of a media layer 704 that often includes channels 706 for fluid flow for cooling the chain (not shown) and the chain bar (FIG. 44). A nose sprocket 708 is positioned at the distal tip of the chain bar for supporting the chain. The chain bar 702 is secured to the wear plate 590A with a chain bar mount 620A secured through appropriate fasteners. The chain is driven by the drive sprocket 566 (FIG. 38) held in place by the retaining plate 570A.

Figure 33:
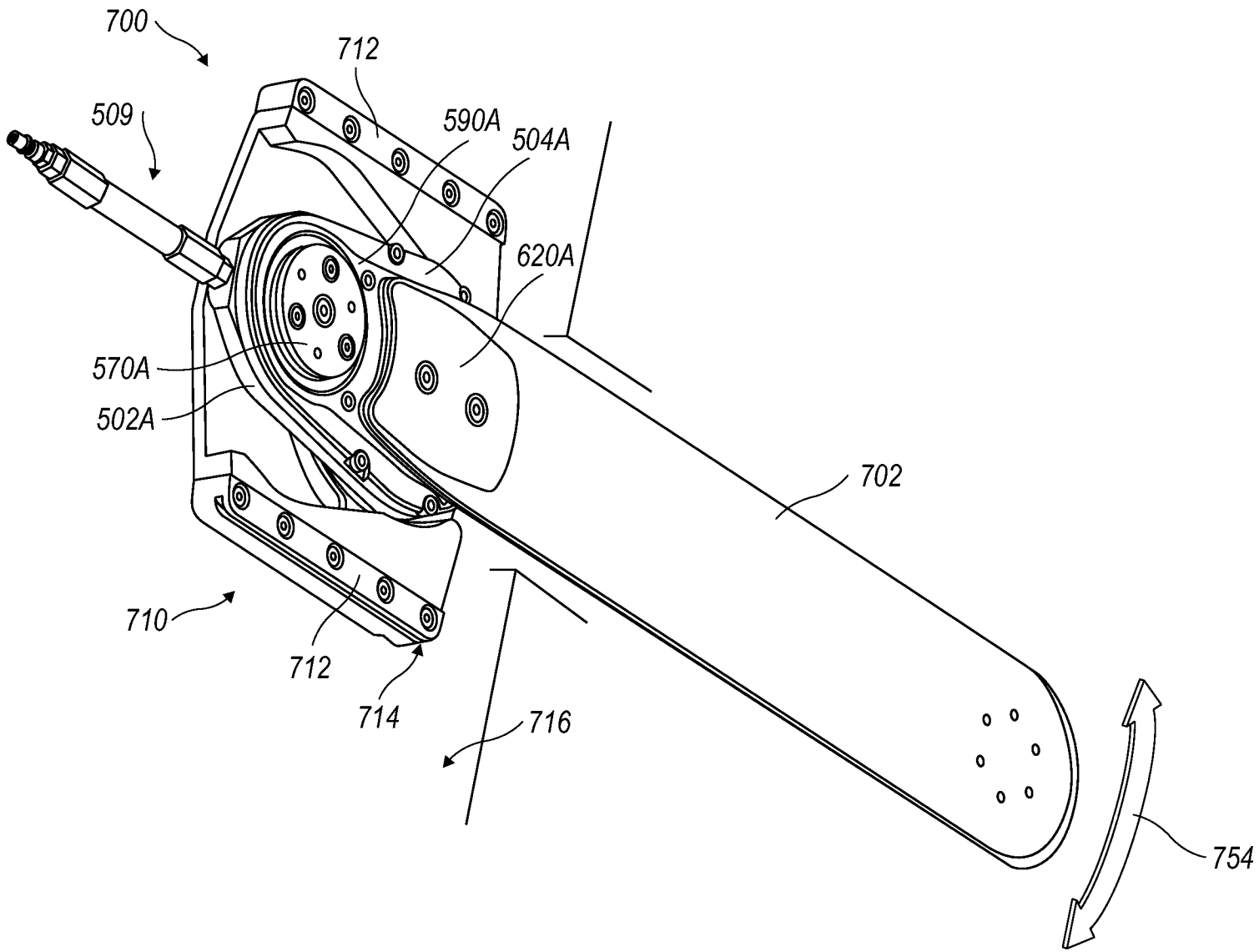
FIG. 33 is a front upper isometric and partial schematic of a chainsaw cutting assembly and guard support depicting a chain bar extending into a cut.

A chain guard support in the form of a swivel 710 is supported by the chainsaw assembly (FIGS. 33-41 and 44). As used herein, the chain guard swivel can be considered part of the chainsaw cutting assembly, for example when the chain guard swivel is supplied with the chainsaw cutting assembly, or it can be considered separate, for example when the swivel is an add-on component. The chain guard swivel can be similar to conventional blade guard support structures in materials, strength characteristics and function. In the present example, the swivel includes support bars 712 secured on oppositely facing lateral sides of the swivel for supporting a conventional blade guard or chain guard. The support bars 712 include grooves 714 for receiving complimentary structures on the guard for sliding the guard in the grooves to reliably support the guard on the swivel. As with blade guards on many wall saws, the swivel 710 can support the guard so that during normal operation, the guard can remain relatively flush to the cutting surface represented schematically at 716 (FIG. 33).

Figure 34:
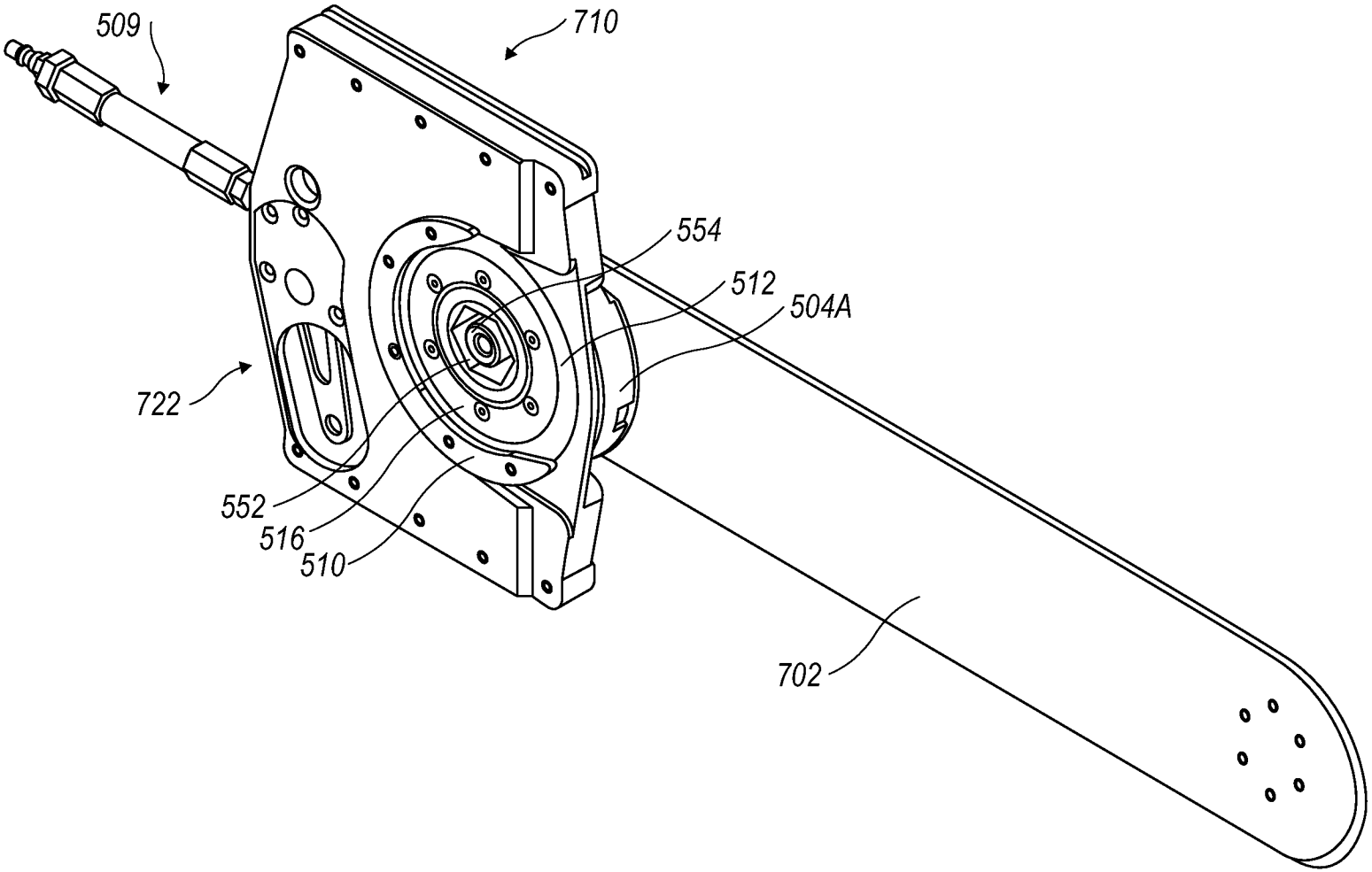
FIG. 34 is a lower rear isometric view of the assembly of FIG. 33.
Figure 35:
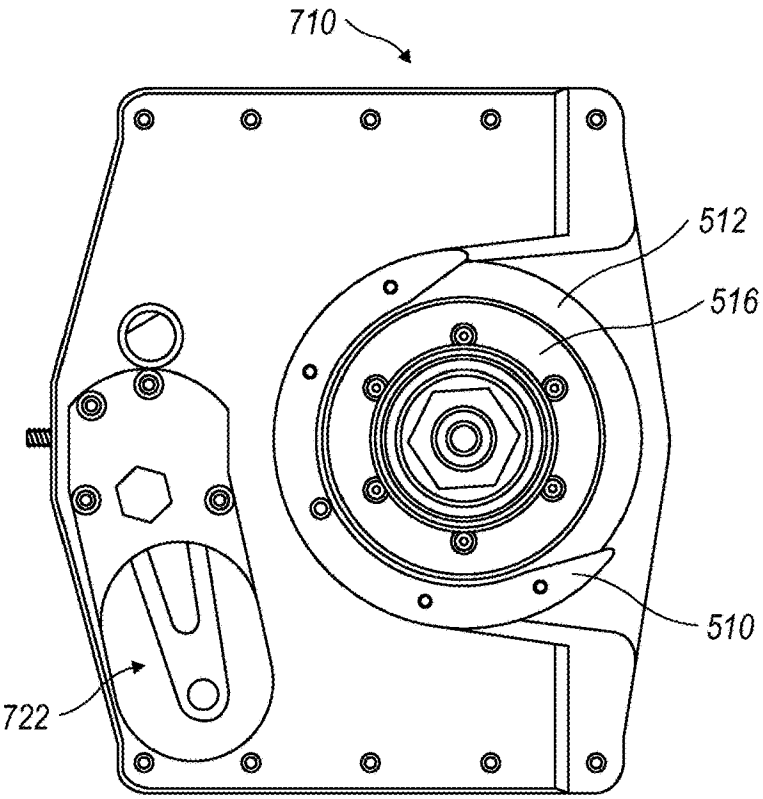
FIG. 35 is a rear elevation view of a guard support and chainsaw gearbox.
Figures 37, 37A:
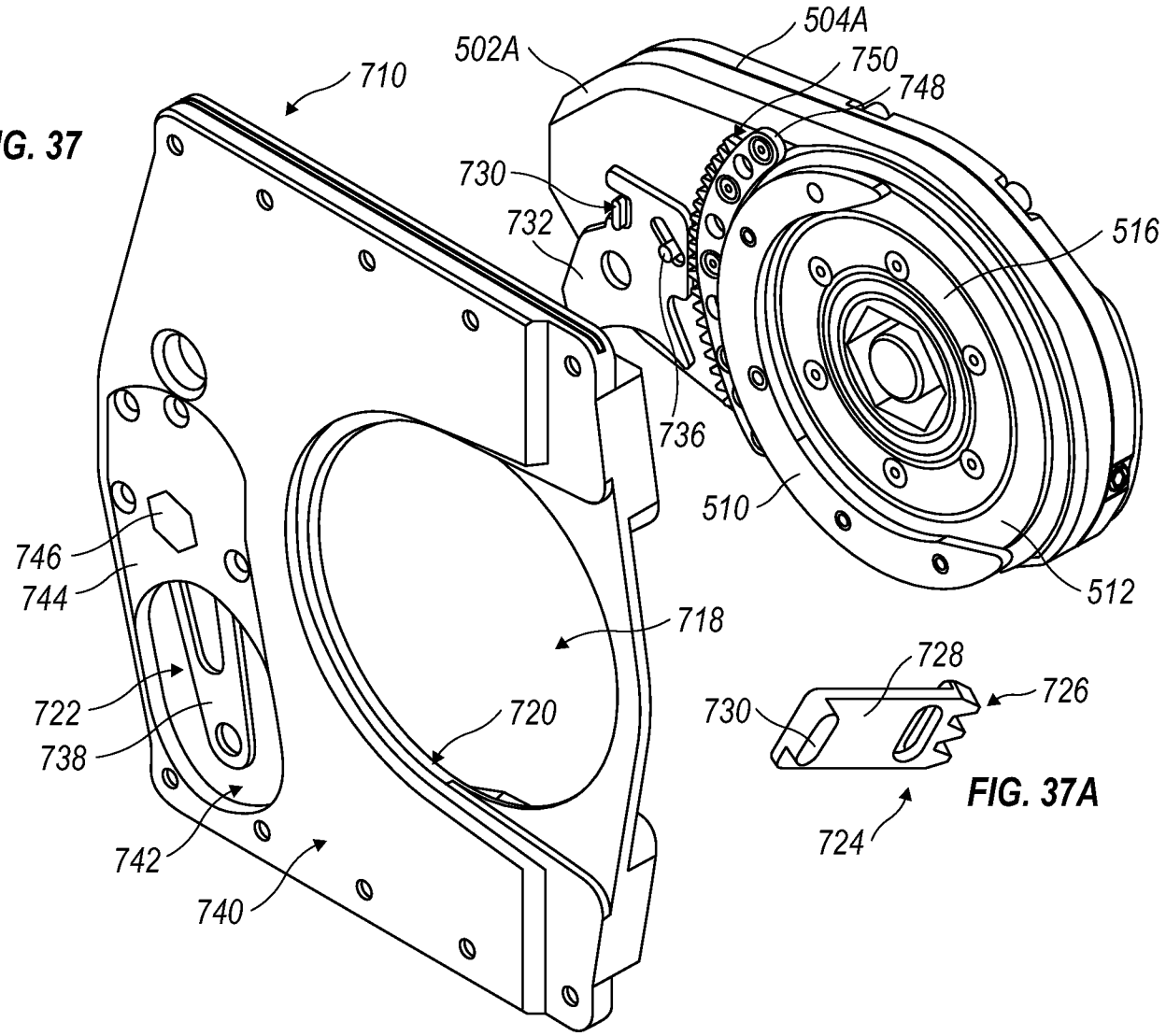
FIG. 37 is a rear isometric and partial exploded view of a guard support and chainsaw gearbox.
FIG. 37A is an upper rear isometric view of an indexing gear for use with the guard support of FIG. 37.
Figure 38:
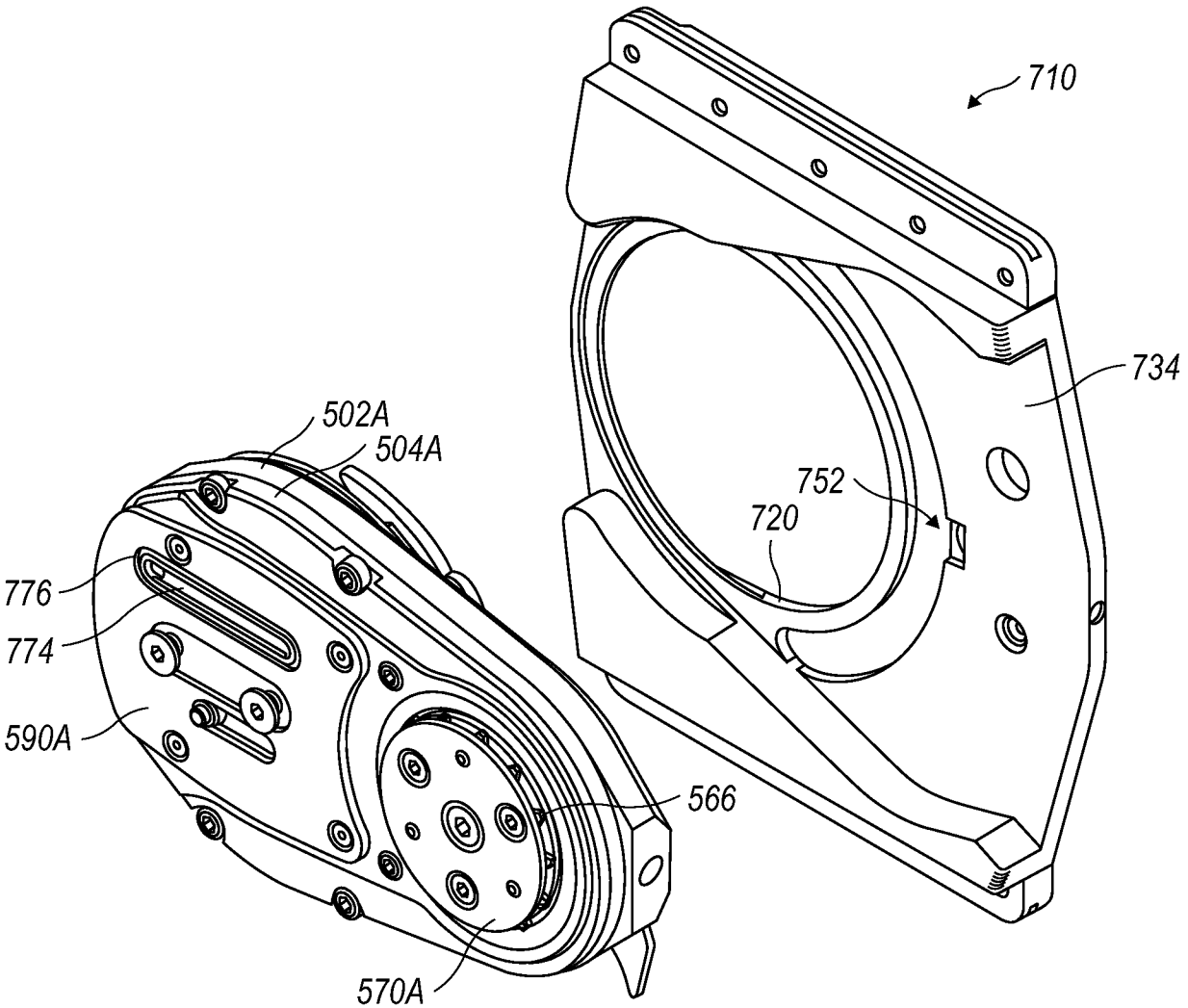
FIG. 38 is an upper front isometric and partial exploded view of the assembly shown in FIG. 37.

The swivel 710 includes an opening 718 defined by a wall 720 (FIGS. 37-38). The wall 720 fits around and is supported by the swivel or collar 512 on the chainsaw assembly (FIG. 34). As supported on the collar 512, the swivel 710 is free to pivot relative to the drive shaft 372 (FIG. 1 A) and the pivot arm of the wall saw, in the same way that the chainsaw gearbox including the inner and outer housings 502A and 504A can pivot relative to the arm. In the present example, the swivel includes an indexing assembly 722 (FIGS. 34-35 and 37). The indexing assembly 722 serves to rotatably engage the swivel 710 with the chainsaw gearbox. The indexing assembly enables the swivel 710 and a gearbox to maintain substantially the same orientation with respect to each other and with the cutting surface, even when the wall saw arm pivots relative to the motor. In this way, the chainsaw, the chainsaw gearbox, the swivel 710 and a chain guard that is supported by the swivel can maintain a relatively constant orientation relative to the cutting surface while the chainsaw is cutting, as well as during insertion and removal of the chainsaw from the cut. While the swivel 710 can be configured to have a single position oriented a relative to the chainsaw gearbox, the present example allows the swivel 710 to take a number of angular positions relative to the gearbox. In the present example, the angle of the swivel relative to the chainsaw gearbox can range from plus/minus 30° from center. This allows the chainsaw the cut at an angle relative to the cutting surface while the swivel and the guard remained relatively flush with the cutting surface.

In the present example, the indexing assembly 722 includes an indexing gear 724 (FIGS. 37 and 37A) having a plurality of teeth 726 supported on one end of a support plate 728 and a bias tab 730 at the opposite end of the support plate. A spring (not shown), bears against the tab 730 to bias the tab and the indexing gear into engagement with the ring gear. On assembly, the indexing gear 724 is sandwiched between the inner housing 502A and a plate 732, which in turn is sandwiched between the indexing gear 724 and an outer cavity wall 734 of the swivel 710 (FIG. 38). A pin 736 moves the indexing gear 724 and lifts it to disengage the indexing gear from the ring gear. The indexing assembly 722 also includes an indexing lever or lifting handle 738 exposed on the inner side 740 of the swivel and to which the pin 736 is mounted. The lever is accessible through an opening 742 in the inner side of the swivel. The lever 738 is retained in place by a cover plate 744. A fastener 746 extends from the cover plate 744 and laterally fixes the lever 738 so it can pivot, and secures the plate 732 in place. When the lever is depressed away from the top of the swivel, it lifts the indexing gear through the pin 736 against the bias of the spring. The swivel 710 can then be pivoted relative to the chain saw gear box. When the lever is released, the indexing gear returns into engagement with the ring gear. The indexing function can also be achieved automatically such as through a linkage to a motor or other drive, or it can be achieved with a powered device under control of a user.

The chainsaw gearbox includes a ring gear 748 positioned radially outward of the support sleeve 510. The ring gear 748 extends over an arc approximately on each side of center of the gearbox and includes teeth 750 to be engaged by the indexing gear 724. The ring gear is fixed relative to the gearbox. The ring gear 748 is positioned and travels in an arcuate groove 752 (FIG. 38) formed in the outer face 734 of the swivel.

During operation, the swivel 710 is placed at the desired orientation relative to the chainsaw gearbox by depressing the lever 738 to thereby lift the lift tab 730 of the indexing gear. When the indexing gear 724 is lifted clear of the ring gear teeth, the swivel 710 along with the indexing assembly and indexing gear 724 can be pivoted on the gearbox surface to the desired position. The lever 738 is then released to allow the indexing gear 724 to reengage the ring gear, thereby securing the swivel in place in its new orientation relative to the gearbox. Through this assembly, the swivel can pivot independently of the gearbox and the wall saw arm, in the present example about an axis coaxial with the input gear and the drive shaft 732. Therefore, not only is the gearbox pivotable relative to the drive shaft and the wall saw arm, the swivel 710 and the chain guard supported by it can also pivot relative to the drive shaft and the wall saw arm. Consequently, even if the wall saw arm pivots relative to the motor, for example for a plunge cut, arc cutting or other positioning of the chainsaw, the chainsaw gearbox and the swivel 710 can remain in their original orientation relative to the cutting surface.

Figure 36:
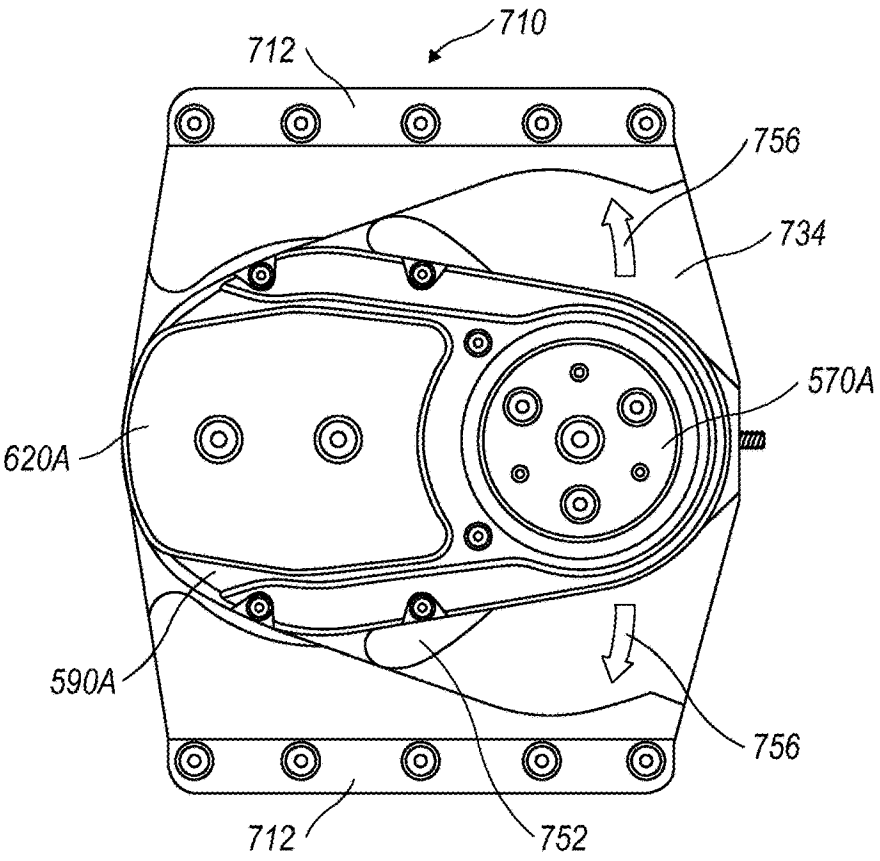
FIG. 36 is a front elevation view of a guard support and chainsaw gearbox.
Figure 39:
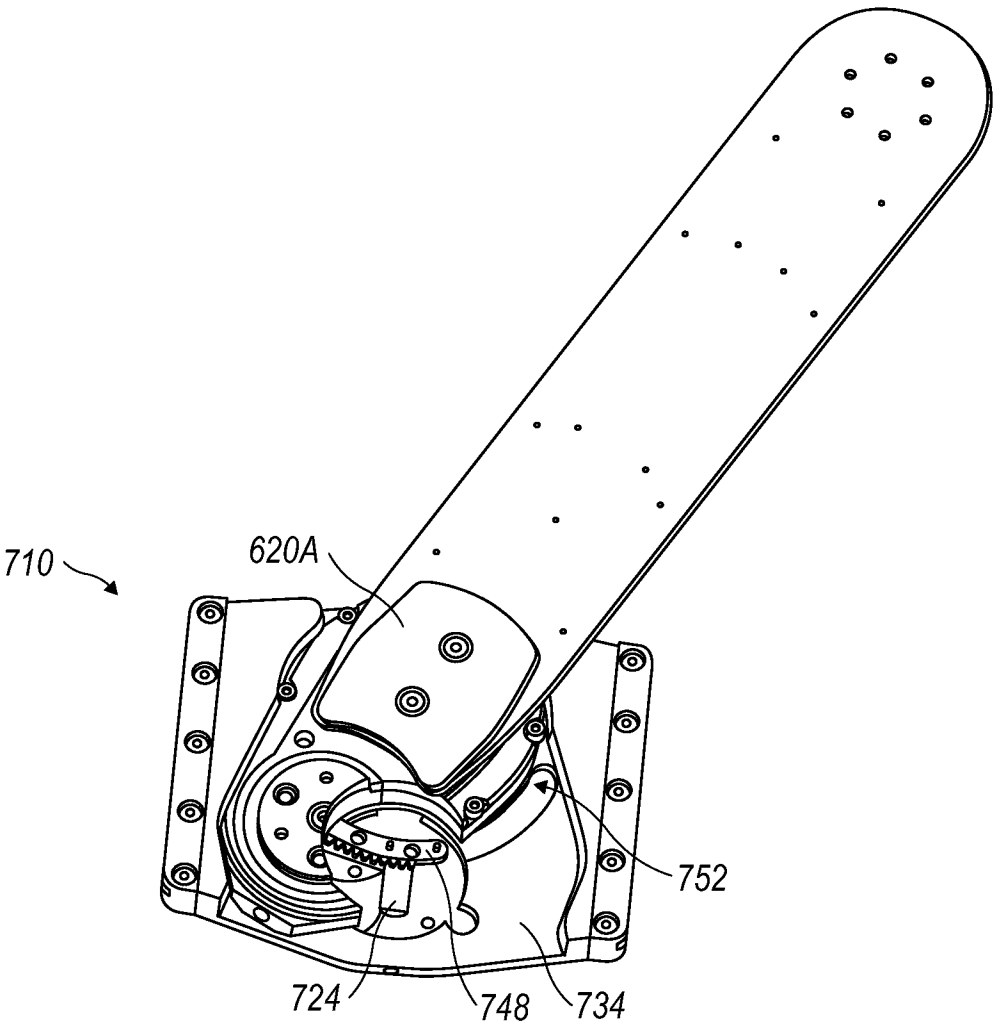
FIG. 39 is an upper front isometric and partial cutaway view of a chainsaw assembly and guard support showing a first relative position of the chainsaw assembly and a guard support.
Figure 40:
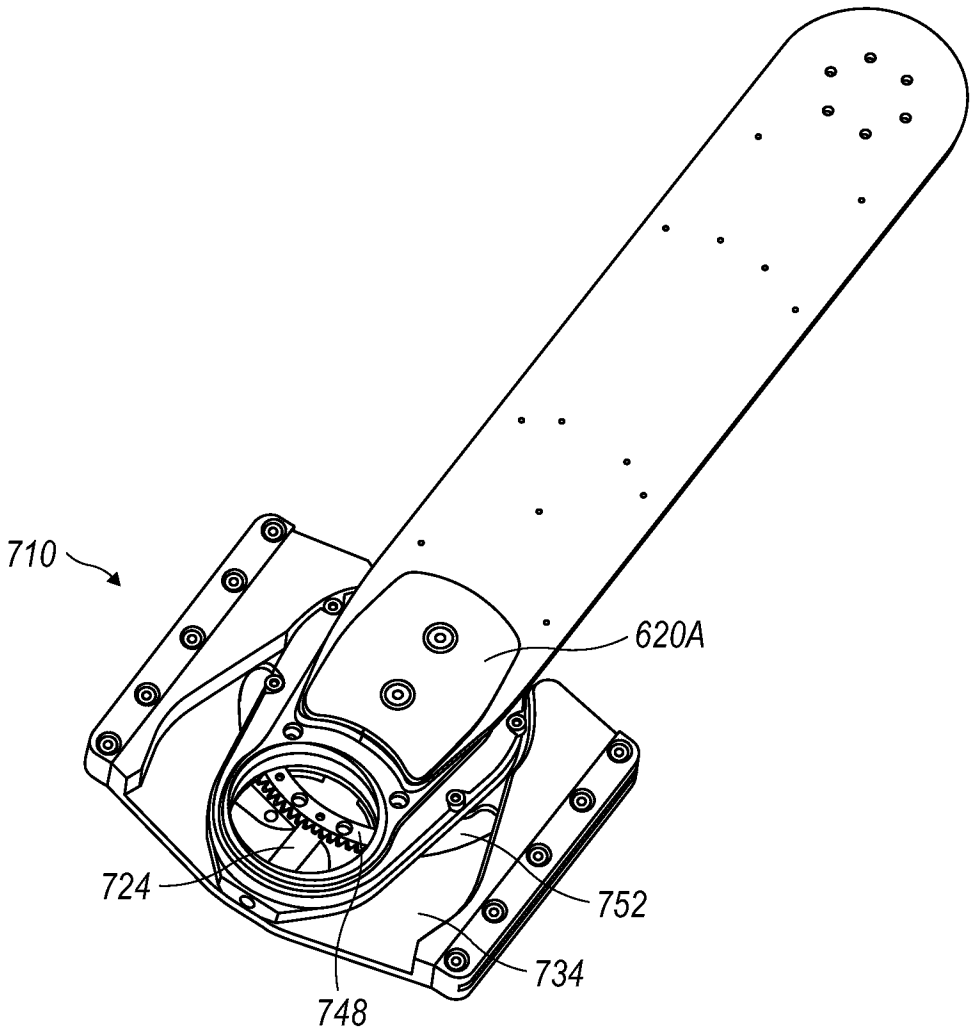
FIG. 40 is another upper front isometric and partial cutaway view of a chainsaw assembly and guard support showing a second relative position of the chainsaw assembly and guard support.
Figure 41:
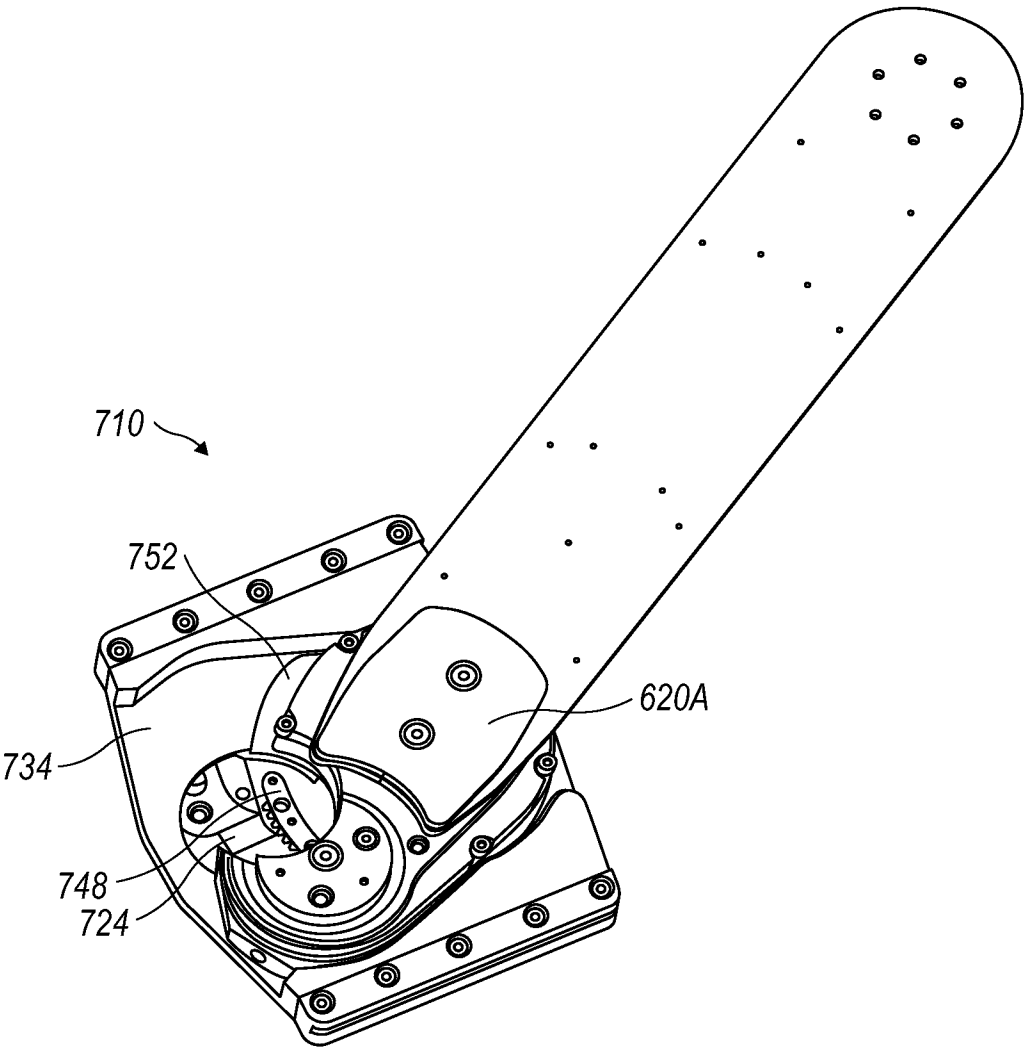
FIG. 41 is a further upper front isometric and partial cutaway view of a chainsaw assembly and guard support showing a third relative position of the chainsaw assembly and guard support.
Figure 42:
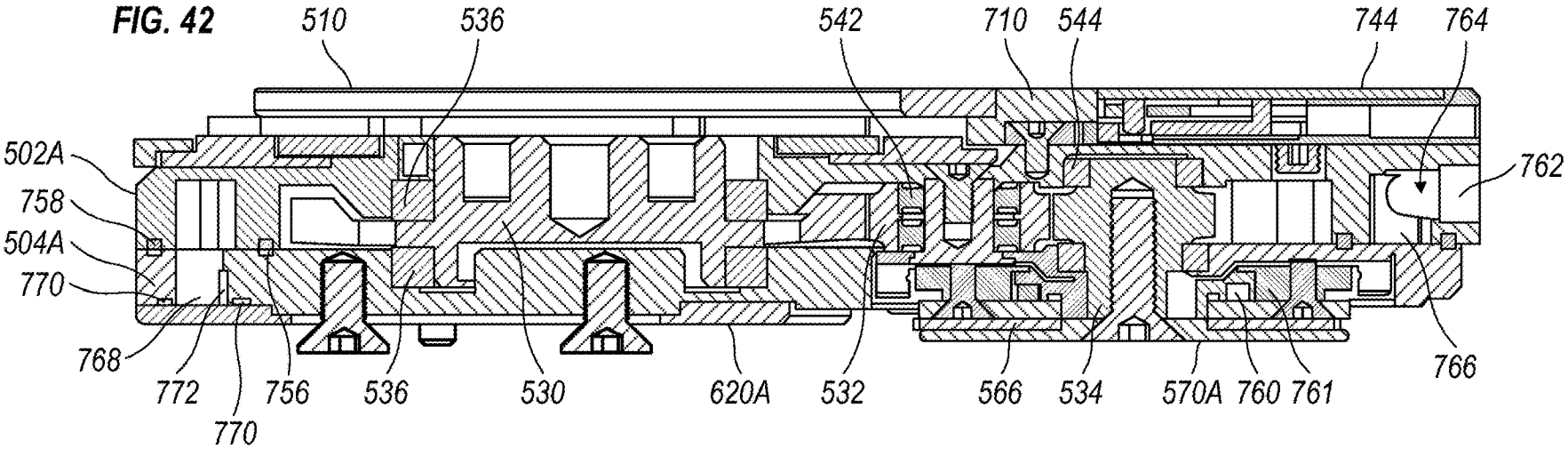
FIG. 42 is a sagittal section of the chainsaw gearbox and guard support.
Figure 43:
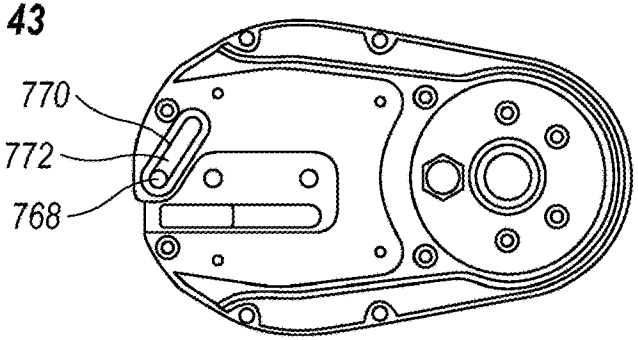
FIG. 43 is a bottom plan view of an outer gearbox housing of the chainsaw gearbox of FIG. 42 and showing water coolant inlet and channel.

The movement of the chainsaw assembly relative to the swivel 710 is depicted in FIGS. 33, 36 and 39-41. As shown in FIG. 33, the chain saw assembly can pivot about an axis coaxial with the drive shaft through an arc represented by the arrow 754. As represented in FIG. 36, the chainsaw gearbox can pivot relative to the cavity formed in the outer surface 734 of the swivel. This movement is represented by the arrows 756. As shown in FIG. 39, the chainsaw assembly is pivoted to the left relative to the swivel 710, and the indexing gear 724 engages the ring gear 748 at one end. As represented in FIG. 40, the chainsaw assembly is substantially centered relative to the swivel 710, and the indexing gear 724 is substantially centered on the ring gear 748. FIG. 41 shows the chainsaw assembly positioned all the way to the right relative to the swivel 710, and the indexing gear 724 engages an end portion of the ring gear 748. FIGS. 39-41 depict the range of relative motion between the assembly and the swivel 710.

The chainsaw gearbox includes the gears, bearings and seals substantially similar to those described with respect to the assembly 500. The inner and outer housings 502A and 504A include inner and outer seal elements 756 and 758. The seal elements seal the gearbox water flow channels, described more fully below. The chainsaw gearbox also includes a clutch element 760 retained by retention plate 761 for the chain drive sprocket The drive sprocket 566 in the assembly 700 is also replaceable.

The gearbox is cooled with water or other fluid. Water is supplied through the hose 509 (FIG. 44) into an inlet 762 (FIG. 42) into peripheral channels 764. Water is diverted into the channels by a sloped diverter 766. Water flows through the peripheral channels 764 formed in the inner housing and the channels extend to the end of the gearbox opposite the inlet 762, at which point the water exits the inner housing 502A into an opening 768 formed through the outer housing element. The opening 768 leads to a channel 772 extending laterally and somewhat toward the inlet 762 to join the fluid manifold 774 (FIG. 38) formed in the wear plate 620A. The wear plate 620A covers the opening 768 and seal elements 770 on each side of the opening 768. The manifold includes a seal 776. The water then enters the chain bar for cooling the chain bar and flushing debris from the chain.

The chain saw assemblies 500 and 700 provide a wall saw mounting interface and a wall saw driveshaft-to-chain bar sprocket rpm interface for easy exchange of a chain bar and a wall saw blade assembly. The chain saw assemblies 500 and 700 also provide an efficient way of putting a chainsaw assembly onto a pivot, for example a wall saw arm. They allow a wall saw to be easily adapted for chain saw cutting, which may also permit using the same power source, same controls, same carriage and motor as used for wall saw cutting. Alternatively, chainsaw assemblies can also be put on pivot arms such as those on wall saws without incorporating all the features described herein. For example, chainsaw assemblies can benefit from use with a pivot arm other than that used on a wall saw, for example to provide more flexibility in manipulating and positioning the chainsaw assembly. For example, a chainsaw assembly mounted on a pivot arm that is also configured for direct drive of the chainsaw can omit conversion gears, and other components, for example where the chainsaw assembly and its driving equipment are used only for chain saw cutting. While such a configuration is simplified, it still benefits from a pivoting arm, especially where the chainsaw is configured to pivot relative to the arm, even while the pivoting arm is also configured to pivot relative to its support, such as a drive motor, carriage or other support structure.

Use of appropriate interfaces between tools and support and driving equipment allows easy and convenient interchange of one tool for another on the equipment. In the present examples, the interfaces allow quick, easy and efficient exchange of saw blades and chainsaw assemblies on wall saw equipment. They allow the tools to take advantage of the pivoting of the tools relative to the motor, and in the examples described herein, they allow the chainsaw and other components on the chainsaw assembly to pivot relative to the pivot arm, as well as independently of each other. With the various pivoting elements, several degrees of freedom for components are provided. For example, the chain saw assembly and any guard support pivot with the arm relative to the motor. Additionally, the chain saw assembly can pivot if desired relative to the arm, and the guard support if desired can pivot relative to both. In the examples of the wall saw, the interchangeability allows, for example, for cutting an opening in a wall using the blade and chainsaw on the same equipment, with more efficient cutting and with more reliable results. Under appropriate circumstances, the cutting blade and the chainsaw can be used with the same controls, same power supplies, same track and carriage configuration and the same motor. The examples described herein also permit operating multiple tools, alternately, using the same power source, same controls, same support equipment and same driving equipment.

Further developments to the arrangements disclosed above are henceforth described. As disclosed above, a chainsaw cutting assembly 500 is described that can be removably engaged with a drive assembly 112. The gear train 525 that has been described serves as an example of a ratio transmission 525 composed of a number of different sized round members. As described below, the gear train or ratio transmission 525 of the present disclosure can be configured in several different ways.

In FIGS. 45-53, several different configurations of interchangeable concrete chainsaw cutting assemblies or heads 500 are shown. Universally, the disclosed chainsaw cutting assemblies 500 are adapted for installation upon a drive assembly 112 as earlier described. The chainsaw cutting assembly 500 is configured and intended to be exchanged for a removed, and different type cutting head assembly. As an example, the different type cutting head assembly can be a rotary saw blade taking the form of the blade cutting head assembly described above.

Figure 45:
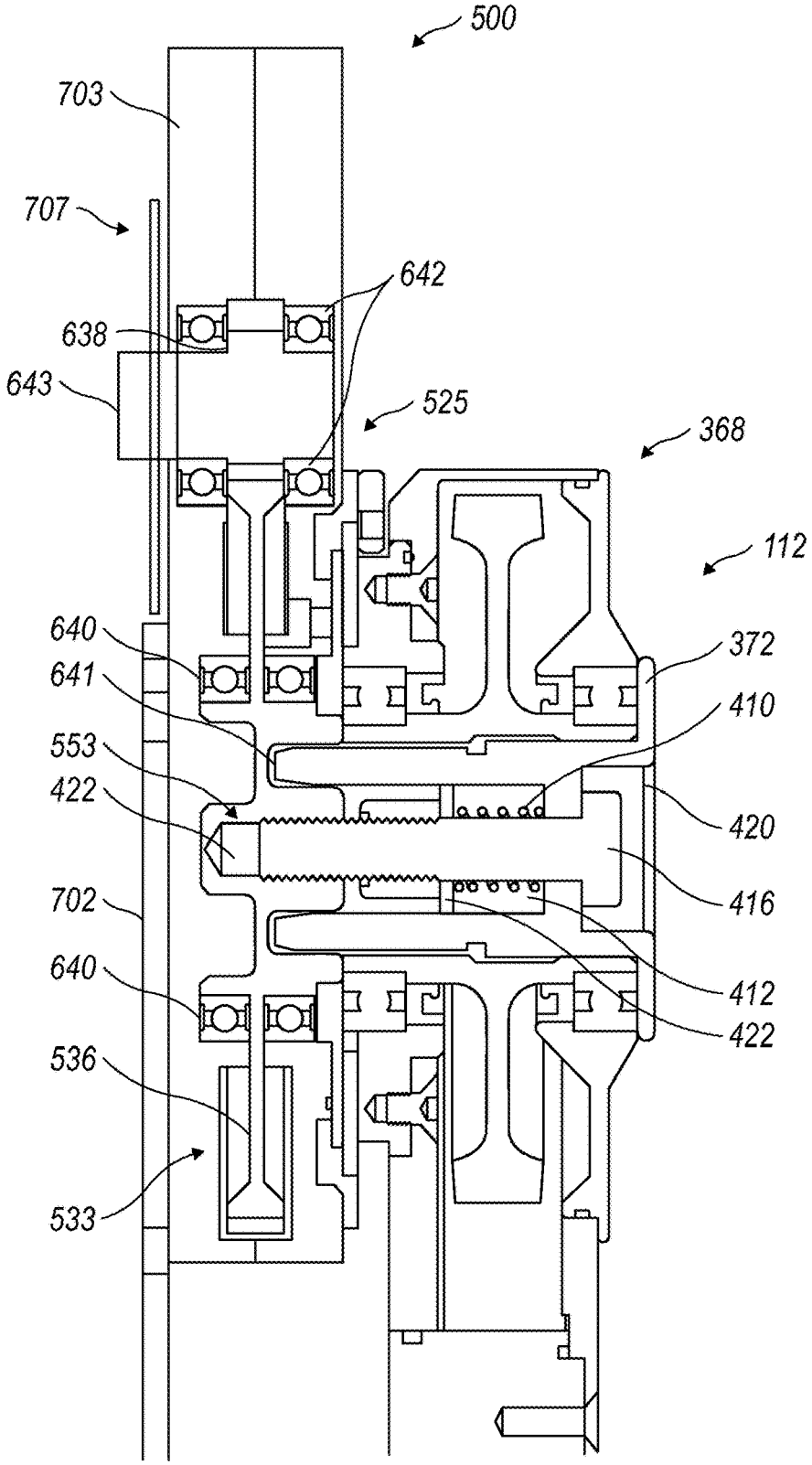
FIG. 45 is a sagittal section of another exemplary chainsaw cutting assembly and drive assembly.

As described above, the chainsaw cutting assembly 500 includes a housing having fasteners (not shown) for releasably attaching the housing to a drive assembly 112 in an installed configuration. For example, FIG. 45 shows a chainsaw cutting assembly 500 adapted to be releasably attached by fasteners to a drive assembly 112. An example of a drive assembly 112 has been described above in relation to at least FIG. 42. Suitable drive assemblies 112 include a drive motor that delivers a motive force from the drive assembly 112. By example, the drive motor can be an electric motor or an hydraulic motor. When the motor is an electric motor, the drive direction can easily be adjusted via switches. In the case where the motor is a hydraulic motor, the rotational direction of the drive force can be controlled using valves to appropriately direct the hydraulic fluid powering the motor. In at least some implementations, the drive motor is remotely powered, for example via a hydraulic power pack.

The gear train described earlier is one example of a ratio transmission 525 disclosed herein. Other ratio transmissions 525 are also disclosed and are described below. In all instances, the ratio transmission 525 of the present disclosure comprises a plurality of interconnected rotatable members. Exemplarily, each rotatable member has a center mounting shaft that is positioned at a distal end thereof at a fixed location on the housing by a corresponding bearing assembly. In each example, the plurality of rotatable members comprise (include) a round, disk-shaped driven member 533 and a round, disk-shaped cutting chain drive member 535. The driven member 533 preferably has a circumference at least twice as long as a circumference of the cutting chain drive member 535.

The driven member 533 has a receiver 553 that interconnects with a driveshaft of the drive assembly in the installed configuration whereby the driven member 533 is rotated by the drive assembly 112. The ratio of the transmissions described herein can range amongst and between approximates of 2 to 1, 3 to 1, 3.3 to 1, 4 to 1, 5 to 1, 6 to 1, 7 to 1, 8 to 1, 9 to 1 or more. Additionally, other ratios within those ranges are also contemplated by this disclosure. In at least one embodiment, the ratio of the transmission is at least 6 to 1. In another embodiment, the ratio of the transmission is greater than 6 to 1. In this context, the stated "ratio" refers to the number of revolutions that will be executed by the cutting chain drive member 535 in correspondence with one revolution executed by the interconnected driven member 533.

Figure 46:
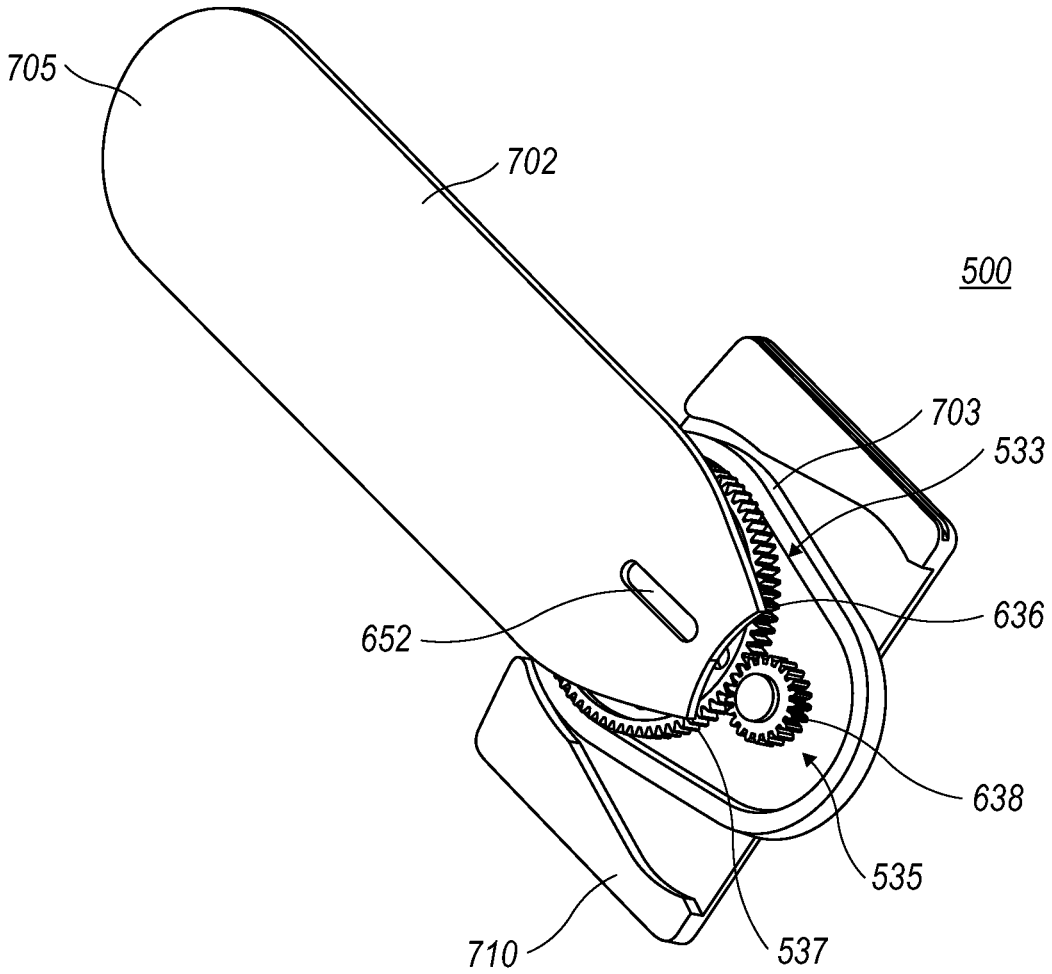
FIG. 46 is front isometric and partial cutaway view of an exemplary chainsaw cutting assembly having two directly engaged gears.
Figure 47:
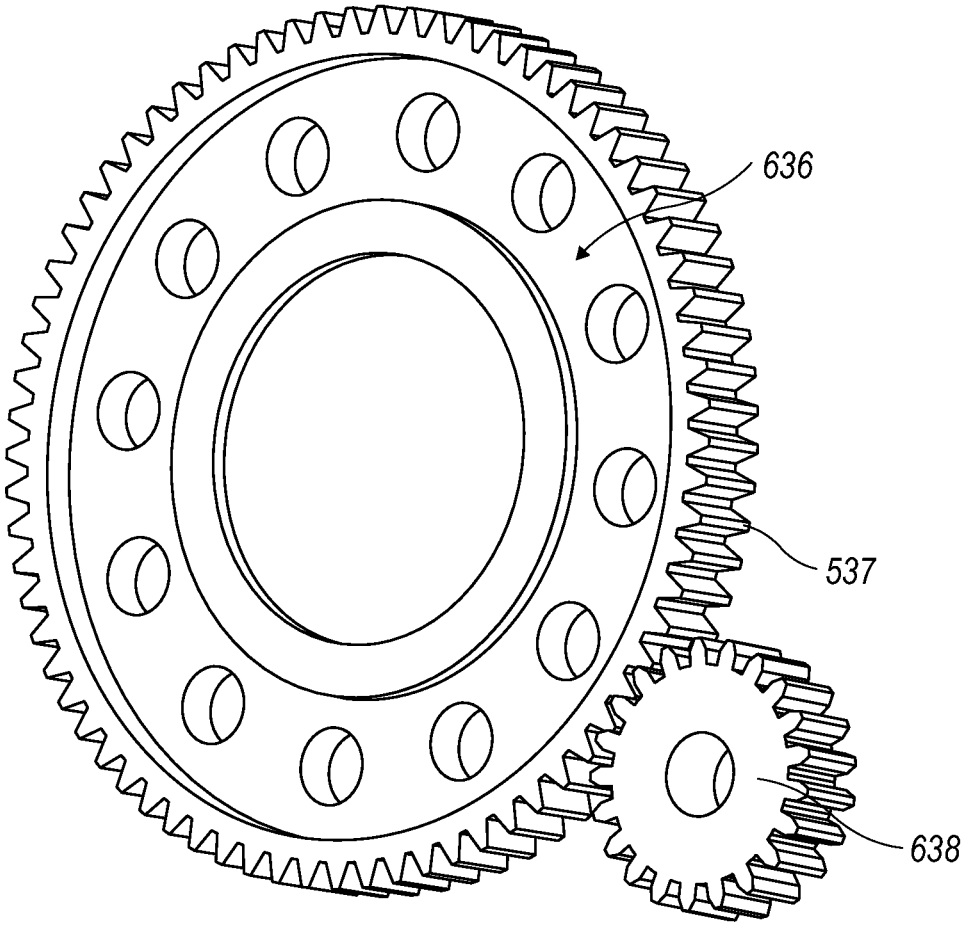
FIG. 47 is an isometric view of the two gears of FIG. 46.

Several different embodiments of ratio transmissions 525 are illustrated in FIGS. 45-53. In FIGS. 45-47, a ratio transmission 525 is shown with sprocket gears constituting the disk-shaped driven member 533 and the disk-shaped cutting chain drive member 535. As shown, each sprocket gear has a series of teeth 537 about its circumference.

An interchangeable concrete chainsaw cutting assembly 500 is depicted in FIG. 45, shown in an installed configuration upon a partially illustrated drive assembly 112. As shown, the drive assembly 112 includes an output portion 368 which is partially illustrated along with a chainsaw cutting assembly 500. Additionally, the output portion 368 includes a blade drive shaft 372 drivingly engaged with the chainsaw cutting assembly 500. The blade drive output shaft 372 can have a circular configuration or be in the form of another shape. For example, the blade drive output shaft 372 can have at least a portion that is hexagonally shaped for mating with a correspondingly shaped receiver on, or connected with the driven member 533. In other implementations, the blade drive output shaft 372 can take other shapes.

As depicted in FIG. 45, a releasable fastener in the form of a blade flange mounting bolt 416 is utilized. As shown, the blade drive output shaft 372 is formed so that the blade flange mounting bolt 416 is recessed within a first bore 410 of the blade drive output shaft 372. The blade flange mounting bolt 416 is threadedly coupled with the chainsaw cutting assembly 500. An optional compression spring 420 can be further included with the fasteners. The compression spring 420 is located between the bottom of the second bore 412 and a retaining ring 422 on the shaft of the bolt 416. The retaining ring 422 is fixed on the bolt axially, and is dimensioned so as to substantially center the bolt in the second bore 412 so that the bolt 416 is aligned with the threaded bore 424 in the chainsaw cutting assembly 500. The compression spring 420 biases the bolt outward of the first bore 410. When the chainsaw cutting assembly 500 is properly aligned with and oriented with respect to the blade drive shaft 372, turning the bolt 416 threads the bolt into the threaded bore 424, drawing the chainsaw cutting assembly 500 into engagement with the blade drive shaft 372 until the blade drive shaft 372 and the chainsaw cutting assembly are fully engaged as shown in FIG. 45.

The chainsaw cutting assembly 500 is depicted in FIG. 45 to include a round, disk-shaped driven member 533 in the form of a driven gear. As illustrated, the blade drive shaft 372 is inserted into the driven gear 636 and further coupled with the blade flange mounting bolt 416. In this manner the driven gear 636 receives power from the blade drive shaft 372. The driven gear 636 rotates, and in turn causes the cutting chain drive member 535 to rotate. As illustrated in FIGS. 46 and 47, the cutting chain driven member 533 is a cutting chain drive gear 638. The driven gear 636 and cutting chain drive gear 638 each have teeth 537 that are located about the respective member's circumference. The teeth 537 of the driven gear 636 and cutting chain drive gear 638 mesh and the cutting chain drive gear 638 is rotated by the driven gear 636. The cutting chain drive gear 638 is operatively interconnected with a drive sprocket 707, whereby rotation of the cutting chain drive member 535 rotates the drive sprocket 707.

The drive sprocket 707 is coupled with a cutting chain. A nose sprocket 708 (not shown) can be located at the nose 705 of the chain bar 702 and rotatably mounted to the chain bar 702. The nose sprocket 708 can allow for increased control over the tensioning of the cutting chain, reduced wear on the chain bar 702, and better alignment on the chain bar 702. When the chainsaw cutting assembly 500 is equipped with both a drive sprocket 707 and a nose sprocket 708, the cutting chain can be suspended on the drive sprocket 707 and nose sprocket 708 for circulation about the chain bar 702. In the embodiments without the nose sprocket 708, the drive sprocket 707 drives the chain in circulation about the chain bar 702 with the nose 705 of the chain bar 702 positioning the cutting chain as it circulates about the chain bar 702.

Additionally, driven gear bearings 640 are located about the driven gear shaft 641 and cutting chain drive gear bearings 642 are located about the cutting chain drive gear shaft 642. The placement and sizing of the driven gear bearings 640 and cutting chain drive gear bearings 642 can increase the life of the bearings. As spacing between the bearing assemblies is increased, their size can be commensurately increased to yield more robust assemblies that provide longer and more reliable operational life.

An isometric and partial cutaway view of the chainsaw cutting assembly 500 is illustrated in FIG. 46. As illustrated, the cutaway exposes the driven gear 636 and cutting chain drive gear 638. As drawn to scale at least in FIG. 47, the driven gear 636 has a circumference at least twice as long as a circumference of the cutting chain drive gear 638. The greater circumference of the driven gear 636 causes the cutting chain drive gear 638 to rotate at a higher revolution per minute as compared to the speed of that corresponding driven gear 636. This increased speed facilitates the cutting chain being rotated at a desired speed, or revolutions per minute. In some embodiments, the circumference of the driven gear 636 can be as great as five times that of the circumference of the cutting chain drive gear 638.

As illustrated in FIG. 46, the chain bar 702 is positioned so that a portion of the chain bar 702 is over the housing 703. The chain bar 702 includes a mounting slot 652 for accepting a mounting device of the housing 703. Additionally, the chain bar 702 can accept a cutting fluid such as water.

FIG. 47 illustrates the driven gear 636 engaged with the cutting chain drive gear 638. As FIG. 47 is drawn to scale, the driven gear 636 has a circumference about 3.3 times larger than that of the cutting chain drive gear 638. The gears can each be coupled to a respective support shaft using a keyway or the like. In other embodiments, the gears can be bonded or welded to the shaft.

When the chainsaw cutting assembly 500 is configured with two direct engaged gears as illustrated in FIGS. 46 and 47, the resulting direction in which the chain is driven is opposite to the rotational drive direction received from the blade drive shaft 372. In some instances, the rotational difference in direction is considered undesirable. In order to accommodate the change of direction when two gears are directly engaged with one another, a reverse direction of the drive output shaft 372 may be required. The reverse direction can be achieved using a valve mechanism when the motor is a hydraulic motor. When the motor is an electric motor, a switch and/or transformer can be implemented to reverse the output rotational direction. In some circumstances, the requirement that the drive direction be reversed is undesirable as it can increase cost and/or user confusion when operating the chainsaw cutting assembly 500.

In an alternative embodiment, and as depicted in FIGS. 48-53, a looped member, mechanism, chain, belt or band 624 is operatively engaged about portions of the circumference of the driven member 533 and the circumference of the cutting chain drive member 535 whereby the driven member 533 rotates the cutting chain drive member 535. In at least one embodiment, a variably configurable tension adjustment mechanism 626 can be engaged with the looped member 624. The tension adjustment mechanism 626 can be a round, disk-shaped wheel having a circumference abuttingly engaged upon an exterior peripheral surface of the looped member 624. The position of the tension adjustment mechanism 626 determines how much inward pressure is exerted on the looped member 624 and in turn, how much the looped member 624 is displaced and correspondingly tightened. Advantageously, the position of the tension adjustment mechanism 626 can be variably controllable, and preferably, it is biased inwardly on the looped member 624 thereby acting as a take-up mechanism for slack that may occur.

In these spaced-apart configurations, the driven member 533 is separated by space, preferably clear space 630, apart from the cutting chain drive member 535. The distance by which the driven member 533 and the cutting chain drive member 535 are separated is preferably less than the diameter of either the driven member 533 or the cutting chain drive member 535. Even more preferable, the amount of clear space 630 separating the driven member 533 from the cutting chain drive member 535 measures less than the radius of either the driven member 533 or the cutting chain drive member 535. In this manner, suitable clearance spacing is provided between the members 533 and 535, but the compact package of the gear train is still maintained.

A goal is to set transmission member separation as described so that the spacing 630 between the driven member 533 and the cutting chain drive member 535 accommodates sufficiently robust bearing assemblies for the members' mounting shafts to facilitate more than an hour of operation from a particular interchangeable concrete chainsaw cutting assembly or head 500. In an exemplary embodiment, the gear train 525 can endure at least two hours of operation due to the robust bearing assemblies having circumferences greater than the gear/pulley members 533, 535 mounted thereto; in a preferred embodiment, the endurance tests to over two hours of use.

When the driven member 533 and cutting chain drive member 535 are sprocket gears 539, such as shown in FIG. 47, each has a series of teeth 537 about the respective member's circumference and the looped mechanism 624 is a roller chain (not illustrated). When the roller chain is utilized, the driven member 533, in the form of a gear, is separated by clear space 630 apart from the cutting chain drive member 535, also in the form of a gear. As described above, the clear space 630 between the driven gear 636 and cutting chain drive member 535 is a distance less than the diameter of either the driven gear 636 or the cutting chain drive gear 638.

In another implementation, the distance of separation by clear space 630 is less than the radius of either the driven gear 636 or the cutting chain drive gear 638. In other implementations, the distance of separation can be as described above regarding suitable separation for accommodating the bearings for the drive gear bearings 640 and chain cutting drive gear bearings 642. The distance of separation is such that the driven gear 636 and cutting chain drive gear 638 are radially spaced apart. The radially spacing can be distances similar to that described above.

As presented with respect to FIGS. 48-53, the present disclosure further includes other looped mechanisms 624 operatively engaged about portions of the circumference of the driven member 533 and circumference of the cutting chain drive member 535, whereby the driven member 533 rotates the cutting chain drive member 535. The specific embodiments presented in these figures can be configured as described above, as well. The looped mechanisms 624 as presented herein can be longer or shorter than illustrated. As the length of the looped mechanism 624 is increased the life of the looped mechanism 624 can be increased as the wear on individual parts of the looped mechanism 624 is decreased. Additionally, a tension adjustment mechanism 626 is illustrated herein. In at least one embodiment, the tension adjustment mechanism 626 can be omitted. When the tension adjustment mechanism 626 is omitted the looped mechanism 624 can have an increased life. The implementation of the tension adjustment mechanism 626, however, allows for greater control over the slippage of the looped mechanism as it engages with at least the cutting chain drive member 535.

Figure 48:
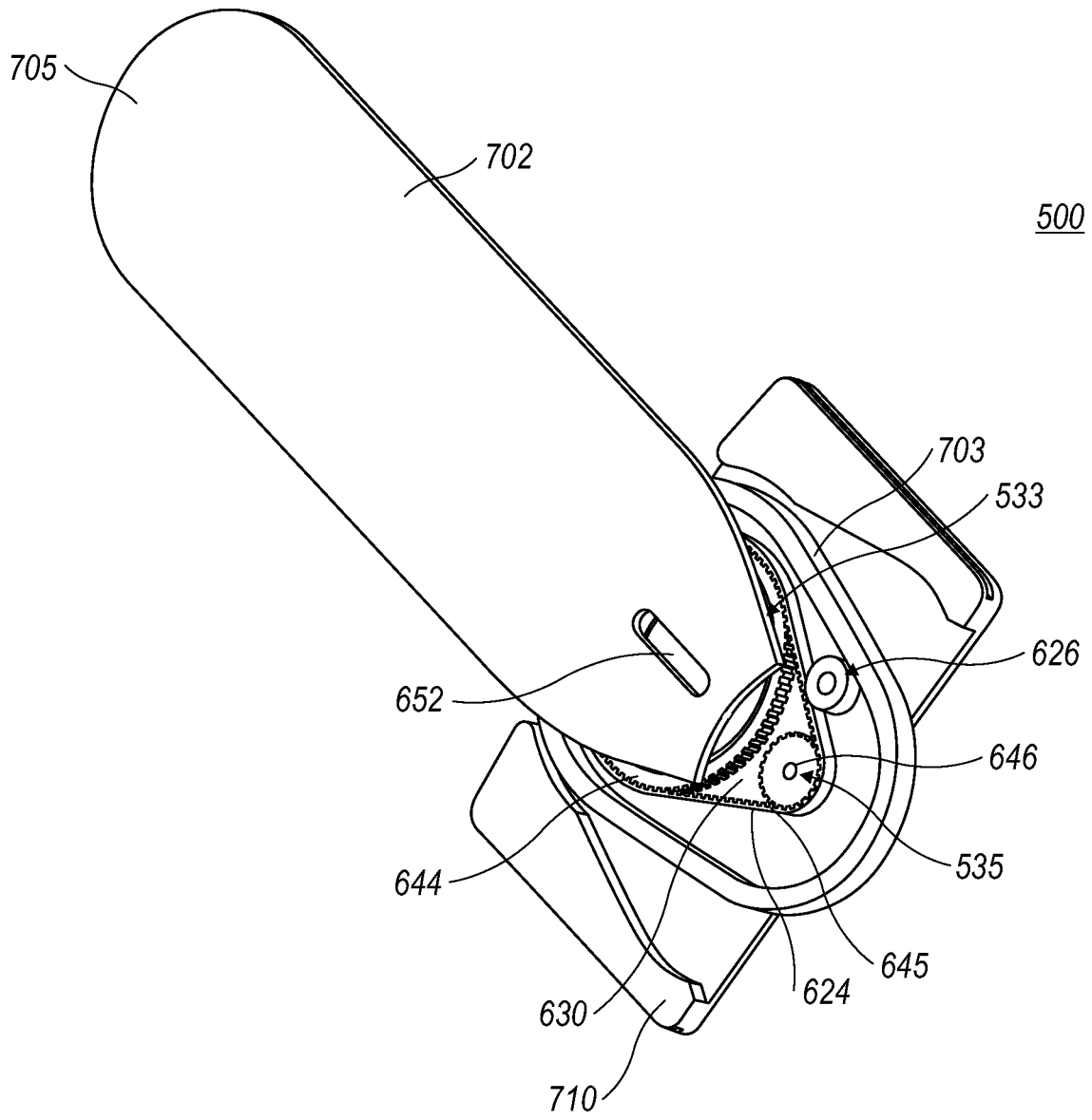
FIG. 48 is a front isometric, partial cutaway view of an exemplary chainsaw cutting assembly having two geared pulleys, a gear belt, and tension adjustment mechanism.
Figure 49:
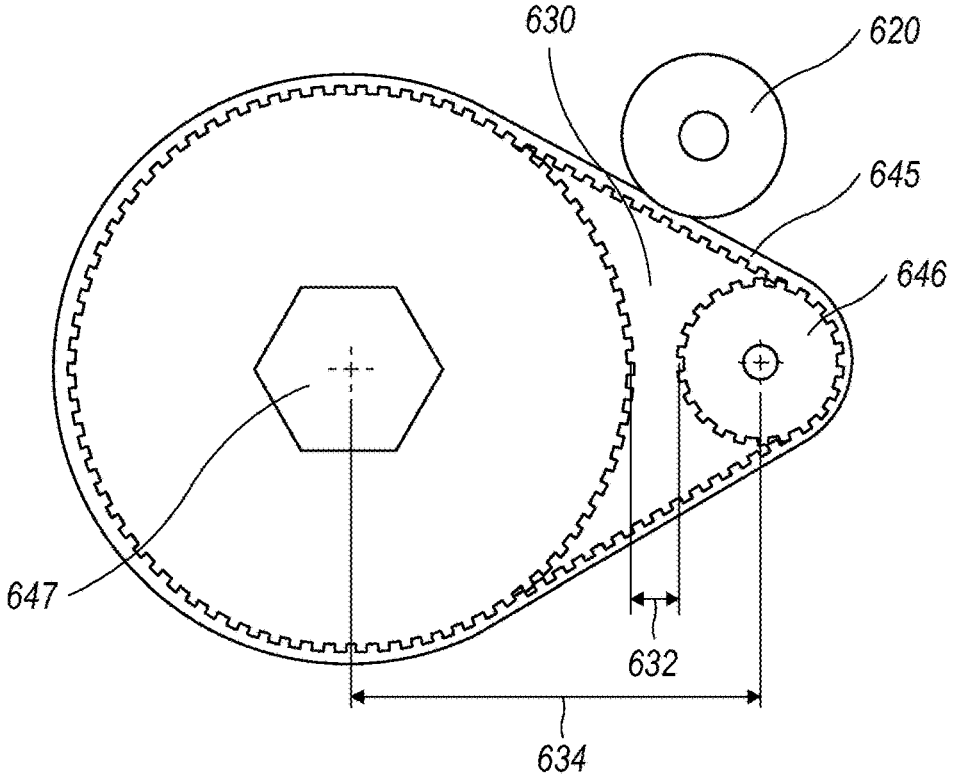
FIG. 49 is an elevational view of the two geared pulleys, gear belt and tension adjustment mechanism of FIG. 48.
Figure 50:
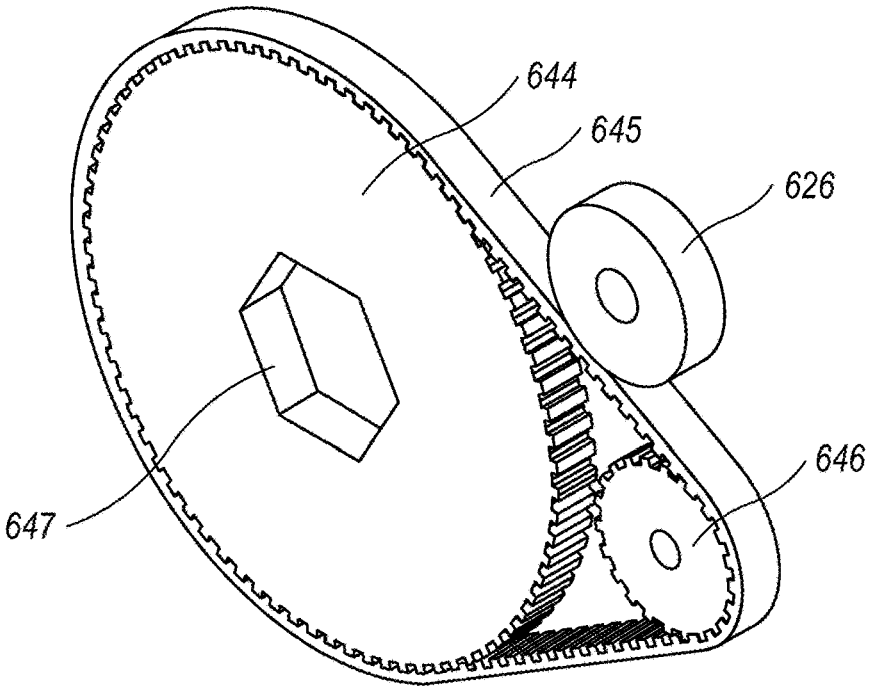
FIG. 50 is an isometric view of the two geared pulleys, gear belt and tension adjustment mechanism of FIG. 48.

In FIGS. 48-50, a looped mechanism 624 in the form of a timing-style, toothed or geared belt 645 is illustrated. The geared belt 645 serves similarly to the above described roller chain.

FIG. 48 is an isometric and partial cutaway view of an exemplary chainsaw cutting assembly 500. As illustrated, the driven member 533 and cutting chain drive member 535 are gear pulleys. These gear pulleys can be configured as described above. Specifically, and as illustrated in FIG. 48, the driven member 533 is a driven gear pulley 644 and the cutting chain drive member 535 is a cutting chain drive gear pulley 646. The driven geared pulley 644 includes a series of teeth 537 about its circumference and the cutting chain drive member 535 includes a series of teeth 537 about its circumference. A geared drive belt 645 connects the driven gear pulley 644 and cutting chain drive gear pulley 646. Additionally, a tension adjustment mechanism 626 that is a round, disk-shaped wheel having a circumference abuttingly engaged upon an exterior peripheral surface of the geared drive belt 645 is illustrated. An elevational view of the driven gear pulley 644, cutting chain drive gear pulley 646, tension adjustment mechanism 626 and gear drive belt 645 is illustrated in FIG. 49. As illustrated, the driven gear pulley 644 features a hexagonal aperture 647. The hexagonal aperture 647 is configured to accept the blade drive shaft 372. A perspective view of the same arrangement is presented in FIG. 50.

Figure 51:
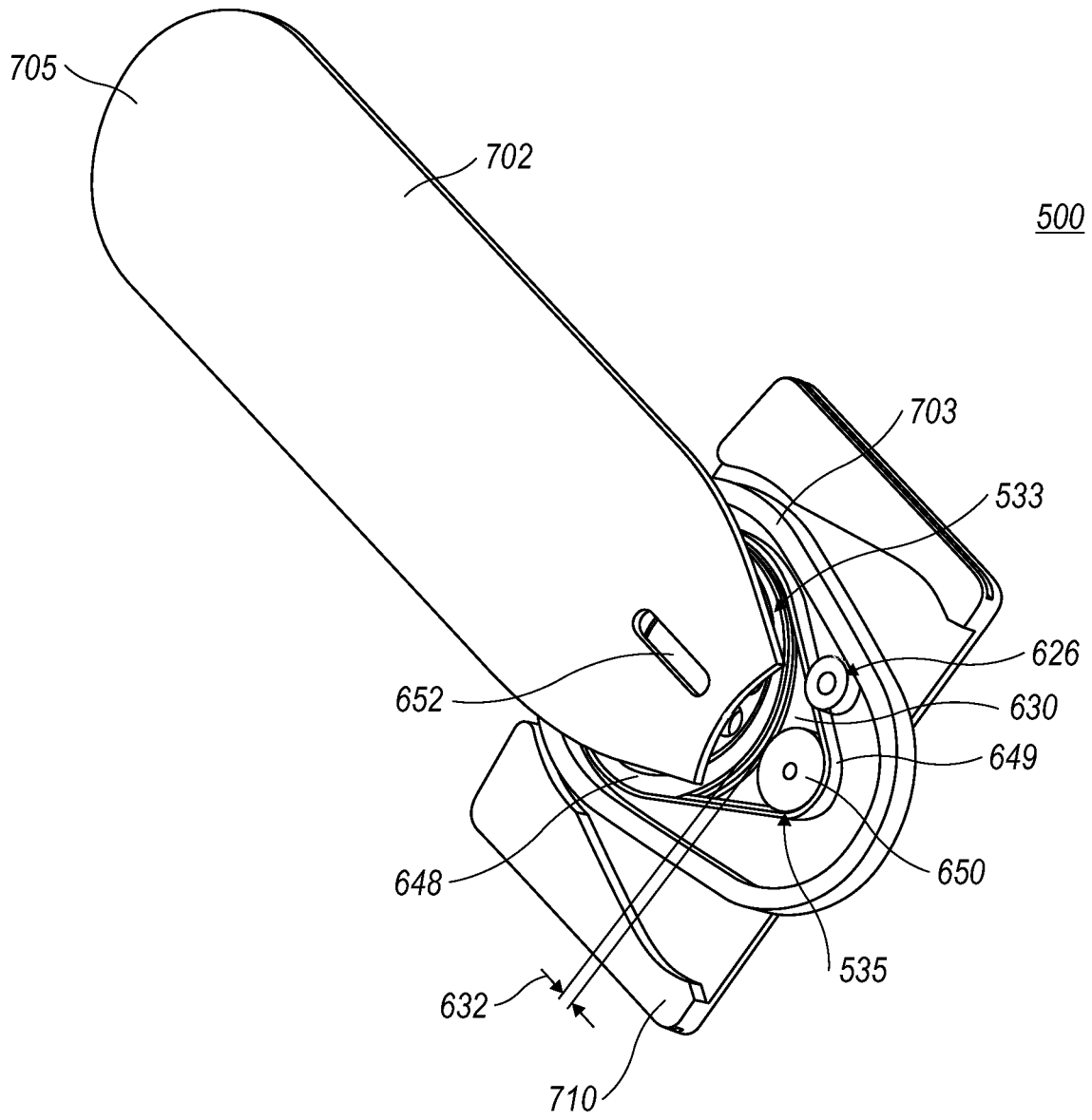
FIG. 51 is a front isometric, partial cutaway view of an exemplary chainsaw cutting assembly having two vee-belt pulleys, a vee-belt, and tension adjustment mechanism.
Figure 52:
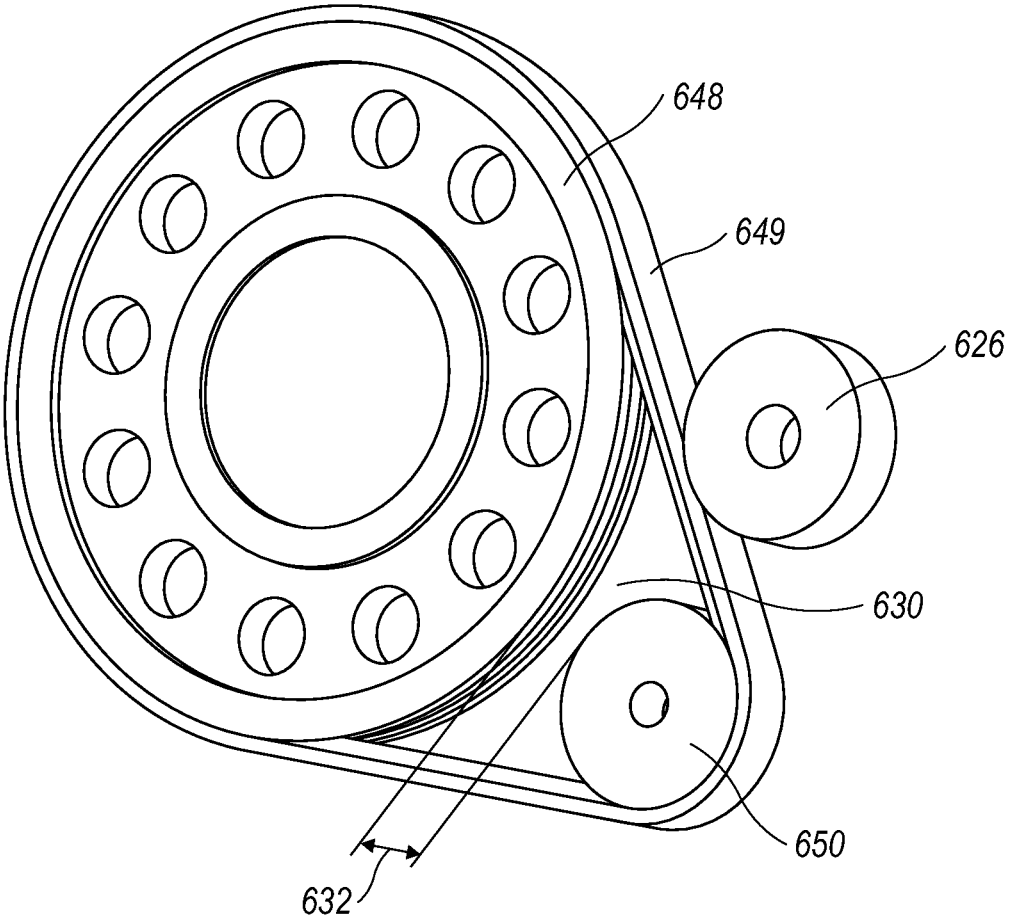
FIG. 52 is an isometric view of the two pulleys, vee-belt and tension adjustment mechanism of FIG. 51.

FIGS. 51-52 present a looped mechanism in the form of a vee-belt 649 having multiple insert ridges or vees. The vee-belt 649, as illustrated, has four vees. FIG. 51 is an isometric and partial cutaway view of another chainsaw cutting assembly 500. As shown, the driven member 533 is a driven vee-belt pulley 648 and the cutting chain drive member 535 is a cutting chain drive vee-belt pulley 650. These vee-belt pulleys can be configured as described above in relation to the driven member 533 and cutting chain drive member 535. Specifically, as illustrated, the driven vee-belt pulley 648 includes four vees. The cutting chain drive vee-pulley 650 also includes four vees. The vee-belt connects the driven vee-pulley 648 and the cutting chain drive vee-pulley 650. Additionally, a tension adjustment mechanism 626 that is a round, disk-shaped wheel having a circumference abuttingly engaged upon an exterior peripheral surface of the vee-belt 649 is illustrated.

Figure 53:
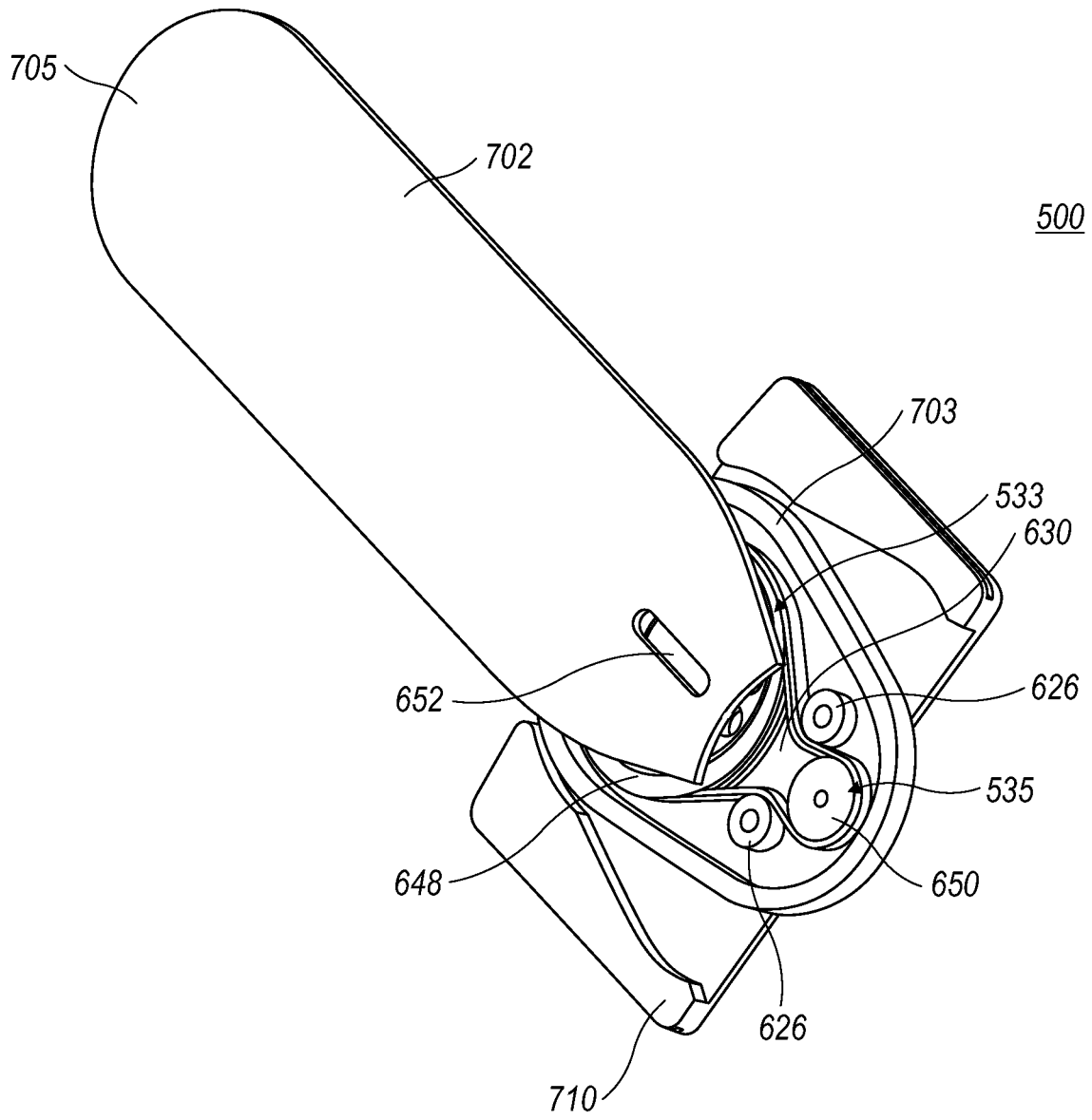
FIG. 53 is a front isometric, partial cutaway view of an exemplary chainsaw cutting assembly having two vee-belt pulleys, a vee-belt, and a tension adjustment assembly including two tension adjusting mechanisms.

In another embodiment illustrated in FIG. 53, two tension adjustment mechanisms 626 are implemented. The additional tension adjustment mechanism 626 allows for increased control over the vee-belt 649. When a single tension adjustment mechanism 626 is included it controls the engagement of the looped mechanism 624 (for example a chain or belt) when it engages with the cutting chain drive member 535 as described above. The inclusion of an additional tension adjustment mechanism 626 allows for enhanced control over the engagement of the looped member with the cutting chain drive member 535. Specifically, the inclusion of two tension adjustment mechanism 626 allows for greater control when the looped mechanism 624, for example the vee-belt 649, can be driven in a clockwise or counter-clockwise direction. As described above, the ability to change the direction of the looped mechanism 624 can allow for the ability to control the direction of cutting by the chainsaw cutting assembly 500.

The above described ratio transmissions 525 can be implemented with the chainsaw cutting assembly 500 presented herein.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A concrete cutting machine comprising:

a motor having an output drive;

a pivot arm having an input coupled to the output drive for receiving power from the motor, wherein the arm is configured to pivot relative to the motor, and wherein the pivot arm has a pivot arm output; and a concrete cutting chain assembly supported on the pivot arm and having a power input coupled to the pivot arm output and wherein the chain assembly is configured to be pivotable relative to the pivot arm.

2. The machine of claim 1 wherein the pivot arm output includes a driveshaft having a driveshaft axis and wherein the chain assembly pivots about the driveshaft axis.

3. The machine of claim 1 wherein the pivot arm has a mounting element configured to accept either one of a circular saw blade and a chain bar assembly.

4. The machine of claim 1 wherein the pivot arm is configured to pivot in a plane parallel to a cutting plane.

5. The machine of claim 1 further including a support element supported by the pivot arm and wherein the support element is configured to be pivotable independently of the chain assembly.

6. The machine of claim 1 wherein the motor includes a securement configured to secure the motor to a carriage.

7. The machine of claim 1 wherein the motor includes a drive element configured to pivot the pivot arm.

8. The machine of claim 1, further comprising a round, disk-shaped driven member and a round, disk-shaped cutting chain drive member, said driven member having a circumference at least twice as long as a circumference of the cutting chain drive member.

9. The machine of claim 8, further comprising a looped mechanism.

10. The machine of claim 9, wherein the looped mechanism is one of a chain, drive belt, vee-belt, or multiple vee-belt.

11. The machine of claim 1 wherein the concrete cutting assembly is removably mounted to the pivot arm such that when the concrete cutting assembly is removed from the pivot arm, a circular saw cutting assembly or a chain saw cutting assembly is attachable to the pivot arm and coupled to the output drive.

12. The machine of claim 1 further comprising a drive assembly supported relative to the motor and having a drive input coupled to the output drive and an assembly drive output; and an interface on the drive assembly configured to support the concrete cutting chain assembly so as to be driven by the assembly drive output and configured to support a cutting blade or a chain saw assembly from the same interface when the concrete cutting chain assembly is removed.

* * * * *